US005425183A

United States Patent [19]

Taylor

[11] Patent Number: 5,425,183

[45] Date of Patent: Jun. 20, 1995

[54] METHOD AND APPARATUS FOR PRODUCING AND DELIVERING SOLVENT VAPOR TO VESSEL INTERIORS FOR TREATING RESIDUE DEPOSITS AND COATINGS

[75] Inventor: Donald F. Taylor, Bangor, Pa.

[73] Assignee: Vacon Technologies, Inc., Commack, N.Y.

[21] Appl. No.: 803,119

[22] Filed: Dec. 4, 1991

[51] Int. Cl.[6] ..... F26B 21/06

[52] U.S. Cl. ..... 34/73; 34/60

[58] Field of Search ..... 34/73, 74, 75, 12, 22, 34/60

[56] References Cited

U.S. PATENT DOCUMENTS

| | | |
|---|---|---|
| 2,571,328 | 12/1947 | Baker . |
| 2,956,911 | 3/1956 | Jelen . |
| 3,042,553 | 10/1959 | Kearney et al. . |
| 3,046,163 | 4/1960 | Kearney et al. . |
| 3,348,934 | 12/1964 | Hinson et al. . |
| 3,760,566 | 3/1971 | Zievers et al. . |
| 3,794,524 | 11/1972 | Nogueira . |
| 3,839,087 | 11/1972 | Beckers . |
| 3,881,949 | 2/1973 | Brock . |
| 4,029,517 | 3/1976 | Rand . |
| 4,101,340 | 3/1977 | Rand . |
| 4,231,804 | 1/1979 | Petterson et al. . |
| 4,231,805 | 1/1979 | Petterson et al. . |
| 4,289,542 | 6/1980 | Roehl . |
| 4,303,454 | 7/1980 | Petterson et al. . |
| 4,357,175 | 11/1982 | Buffington et al. . |
| 4,424,080 | 1/1984 | Days . |
| 4,469,143 | 9/1984 | Vazin . |
| 4,530,131 | 7/1985 | Zell et al. . |
| 4,778,535 | 10/1988 | McCord . |
| 4,836,858 | 6/1989 | Reinhart . |
| 4,900,364 | 2/1990 | Diedrich . |
| 4,947,591 | 8/1990 | Risley . |
| 5,017,240 | 5/1991 | Brown . |

OTHER PUBLICATIONS

"Technical, Environmental, And Economic Evaluation Of Plastic Media Blasting For Paint Stripping," by Charles H. Darvin and Roger C. Wilmoth, Jan. 1987.

The Vaporized Solvent Cleaning Process, En-Pro Associates, Inc., Staten Island, New York.

Air Purification Systems From Calgon Carbon Corporation, Calgon Carbon Corporation, Bulletin No. 27-170a, Pittsburgh, Pennsylvania.

Ventforb, Calgon Carbon Corporation, Bulletin No. 27-280, Pittsburgh, Pennsylvania, Aug. 1991.

Vapor Pac Service For VOC Control, Calgon Carbon Corporation, Bulletin No. 27-173d, Pittsburgh, Pennsylvania, Mar. 1991.

Vapor-Pac 10 Service For VOC Control, Calgon Carbon Corporation, Bulletin No. 27-265, Pittsburgh, Pennsylvania, Oct. 1990.

Cadre—VOC Contorl Process, Calgon Carbon Corporation, Bulletin No. 27-129b, Pittsburgh, Pennsylvania, Mar. 1991.

High Flow VentSorb® Emission Control Units, Calgon Carbon Corporation, Bulletin No. 27-174d, Pittsburgh, Pennsylvania, Feb. 1990.

*Primary Examiner*—Henry A. Bennett

*Attorney, Agent, or Firm*—Hopgood, Calimafde, Kalil & Judlowe

[57] ABSTRACT

Method and apparatus for producing and recovering solvent vapor for cleaning the interior surfaces of substantially sealed vessels and the exterior surfaces of structures contained therein]. In the illustrated embodiment, a transportable vessel cleaning system is disclosed. The system comprises a plurality of solvent vapor producing chambers, each having a solvent vapor outflow port and a solvent vapor inflow port coaxially arranged along a vapor flow axis extending through each chamber along flow channels associated with the solvent vapor outflow and inflow ports. When operationally configured with a substantially sealed vessel, each solvent vapor producing chamber of the present invention produces a solvent vapor stream which is recirculated through the vapor delivery tube, vessel interior, vapor recovery tube and the solvent vapor producing chamber along the direction of its vapor flow axis. Each recirculating solvent vapor stream facilitates heat and solvent vapor fluxes between the solvent vapor producing chamber and the vessel interior which are sufficient to maintain saturated solvent vapor in the vessel at very high temperatures during cleaning operations.

77 Claims, 10 Drawing Sheets

METHOD AND APPARATUS FOR PRODUCING AND DELIVERING SOLVENT VAPOR TO VESSEL INTERIORS FOR TREATING RESIDUE DEPOSITS AND COATINGS

BACKGROUND OF THE INVENTION

1. Field of Invention

The present invention relates generally to a method and apparatus for producing and delivering solvent vapor to the interior of vessels such as ship storage compartments, tank trucks, rail cars, land tanks and the like, so that residue deposits and/or protective coatings on the interior surfaces thereof or objects contained therein are exposed to solvent vapor for the purpose of chemically assisted cleaning and removal.

2. Brief Description of the Prior Art

Now, more than ever, a great need exists to remove residual and protective coatings from the interior surfaces of vessels, such as ship storage compartments, tank trucks, rail cars, land tanks and the like in an environmentally safe, cost-effective manner. Examples of such residue deposits and coatings include oil, grease, crude petroleum products, petroleum asphalt, coal tar products, resinous products, paints, plasticizers, epoxy and the like.

In the past, several different approaches have been used for cleaning these residues and coatings from the interior surfaces of large industrial vessels. For example, U.S. Pat. No. 4,530,131 to Zell, et al. discloses one approach to removing resinous deposits and/or coatings, such as oil and grease, from the interior surfaces of ship storage compartments and bilges. As disclosed, this approach involves the use of cleaning agents such as steam, hot water, detergents and solvents. Generally, these cleaning agents are applied using steam hoses, pressure wands, or rotating spray heads.

Although widely used, this prior art method suffers from a number of significant shortcomings and drawbacks. The required steaming, washing and flushing operations generate large quantities of waste water effluents and air emissions. As these effluents and emissions contain organic and inorganic pollutants, pretreatment processing is required prior to discharge to the environment. This processing involves complicated equipment and enormous time and labor, resulting in high costs. Moreover, since hardened or crystallized material remains on the interior surfaces of the vessel after the cleaning process is completed, chipping, scraping and/or grit blasting operations are also frequently required, resulting in injury to the surface being cleaned, additional expense and further waste disposal concerns.

An alternative approach utilizes suitable hydrocarbon solvents in the vapor state to remove residue deposits and/or protective coatings. Various types of solvents suitable for use in this approach are generally disclosed in column 4 of U.S. Pat. No. 4,357,175 to Buffington, et al. Prior art techniques and apparatus employing this approach can be found in U.S. Pat. Nos. 3,042,553 and 3,076,163 to Kearney, et al., and U.S. Pat. Nos. 4,303,454, 4,231,805 and 4,231,804 to Petterson, et al. The method disclosed in each of these references calls for a chlorinated hydrocarbon solvent such as methylene chloride to be converted to vapor which is then delivered to the interior of the vessel where it contacts the residue deposit and/or protective coating thereby cleaning the same from the interior surfaces. These references propose several types of apparatus for producing and delivering the solvent vapor to vessel interiors.

For example, the apparatus proposed by Kearney et al. employs an evaporation tank which produces solvent vapor that is transported to the vessel interior under high pressure. During vapor cleaning operations, solvent vapor within the vessel interior is withdrawn by a motor driven blower, subsequently condensed to liquid solvent in a condenser, and then returned to the evaporation tank for reuse. Solvent vapor which condenses on the wall surfaces of the vessel interior collects at the bottom thereof and is pumped out during the vapor cleaning operation and returned to the evaporation tank for distillation therein.

A method proposed by Petterson, et al., employs an evaporation tank in which solvent is delivered at about ambient temperature. The method further calls for recirculation of the vapor as a means of increasing vapor concentration within the vessel.

A prior art apparatus utilizing the vapor recirculation disclosed by Petterson has been proposed in which a rectangular shaped evaporator tank is integrally formed with a condenser unit extending from one wall surface, to selectively permit condensing of solvent vapor circulating within the evaporation tank and subsequent collection of solvent condensate for reuse. Through another wall of the evaporator tank opposite the condenser unit, a first port is provided for withdrawal of solvent vapor from the evaporation tank and delivery thereof to the vessel interior using a first vapor tube and a blower unit. Through another wall of the evaporator tank adjacent the condenser unit, a second port is provided for returning solvent vapor from the vessel interior through a second vapor tube.

While this prior art evaporation tank is capable of delivering solvent vapor to the interior of a vessel to be cleaned, the configuration and design of such apparatus is characterized by low vapor flow rates and low heat transfer between the evaporation chamber and the vessel interior.

Consequently, heating of large volume vessel interiors (e.g., ship storage tanks) to high temperatures has not been achievable solely through the heat transfer afforded by the solvent vapor flow stream produced by this apparatus. In addition, maintenance of high solvent vapor concentrations within the vessel interior at such elevated temperatures has likewise been unachievable. The net effect of such limitations has been inefficient use of solvent and reduced efficacy of vessel cleaning operations.

OBJECTS OF THE INVENTION

Accordingly, it is a primary object of the present invention to provide an improved method and apparatus for producing and delivering hot solvent vapor to the interior of a vessel to remove residue deposits and/or protective coatings.

It is a further object of the present invention to provide such apparatus in the form of a vessel cleaning system having a vapor producing chamber which is capable of generating and transporting, through the interior volume of large surface area vessels, a recirculating solvent vapor stream characterized by a high solvent vapor flow rate which facilitates heat and solvent vapor fluxes between the vapor producing chamber and the vessel interior which is sufficient to maintain the concentrated solvent in the vessel at high temperature during cleaning operations.

It is a further object of the present invention to provide such a vessel cleaning system in which the vapor producing chamber is capable of simultaneously generating a plurality of such recirculating solvent vapor streams, each of which is conducted through a distinct solvent vapor flow path.

A further object of the present invention is to provide a vapor cleaning system having a solvent vapor producing chamber through which a pair of axially arranged solvent ports are installed to facilitate recirculation of a solvent vapor stream between the solvent vapor producing chamber and a vessel interior being cleaned.

A further object of the present invention is to provide such a vapor cleaning system, in which the rate of enriching the solvent vapor stream is controlled by measuring the percentage of solvent vapor within the solvent vapor stream.

A further object of the present invention is to provide an improved method of cleaning the interior surfaces of a vessel, wherein during the solvent vapor cleaning cycle, a vapor generating chamber generates and delivers solvent vapor to the vessel interior, and solvent vapor therein condenses on the interior surfaces of the vessel and is recovered from the bottom thereof along with dissolved residue and/or coating deposits, so that all interior surfaces of the vessel are exposed to and chemically treated by solvent vapor prior to completion of the vapor cleaning cycle and evacuation of solvent vapor from the vessel interior.

A further object of the present invention is to provide such an improved method, wherein during the solvent vapor cleaning cycle, the mixture of solvent vapor condensate and dissolved residue and/or coating deposits is transported to an independent distillation chamber within which solvent vapor condensate is recovered by distillation and thereafter returned to the solvent vapor producing chamber.

Another object of the present invention is to provide a transportable vessel cleaning system, in which a plurality of recirculating solvent vapor streams can be simultaneously generated from a solvent vapor producing chamber and transported through the sealed interiors of a number of vessels.

A further object of the present invention is to provide such a transportable vapor cleaning system which can be fully operated using steam, pressurized air and water supplies readily available on the site at which the vessel resides.

An even further object of the present invention is to provide such a transportable vapor cleaning system, in which the solvent vapor outflow and inflow ports, through which each recirculating solvent vapor stream passes, are axially arranged on opposite sides of the platform supporting the solvent vapor producing chamber so as to facilitate identification and coordination of the flexible vapor delivery and recovery tubes respectively connected to these ports.

Yet an even further object of the present invention is to provide such a transportable vapor cleaning system which is capable of safely evacuating residual solvent vapor within the vessel interior and filling the same with ambient air during a single stage solvent vapor evacuation cycle.

These and other objects of the present invention will become apparent hereinafter and in the claims.

SUMMARY OF INVENTION

The present invention provides a method and apparatus for producing a solvent vapor stream for delivery to the interior of a substantially sealed vessel so that the interior surfaces thereof or objects contained therein are exposed to the delivered solvent vapor for the purpose of chemically assisted cleaning and removal of residue deposits and/or protective coatings.

In general, the apparatus comprises at least one solvent vapor producing chamber having a vapor collecting portion for collecting solvent vapor produced therein. The solvent vapor producing chamber also has solvent vapor outflow and inflow ports which are both disposed substantially along a vapor flow axis extending through these ports and the vapor collecting portion of the solvent vapor producing chamber. The solvent vapor outflow port is adapted to receive one end of a vapor delivery tube which is capable of establishing a first vapor communication pathway between the vapor collecting portion and the interior of the vessel. Similarly, the solvent vapor inflow port is adapted to receive one end of a vapor recovery tube which is capable of establishing a second vapor communication pathway between the vessel interior and the vapor collecting portion. A vapor transporting device operably associated with at least one of the solvent vapor outflow and inflow ports is provided for forcibly transporting solvent vapor in the vapor collecting portion through the solvent vapor outflow port and the vapor delivery tube and into the vessel interior. The vapor transporting device also forcibly transports solvent vapor from the vessel interior through the vapor recovery tube and the solvent vapor inflow port, and into the solvent vapor producing chamber. In this way, solvent vapor recovered from the vessel interior intermixes with solvent vapor forming in the solvent vapor producing chamber to produce a solvent vapor stream along the direction of the vapor flow axis for delivery to the vessel interior.

In the illustrated embodiment, the present invention is embodied in a transportable vessel cleaning system having a plurality of independent solvent vapor producing chambers. The solvent vapor outflow and inflow ports each comprise flow channels aligned substantially coaxially along the vapor flow axis, and the vapor transporting device comprises a turbine fan disposed in the flow channel of the solvent vapor outflow port. Below the vapor collecting portion is a solvent reservoir for containing solvent which, when heated by a solvent heating unit, causes solvent vapor to form. To reduce entrainment of liquid solvent as the solvent vapor stream flows along the direction of the vapor flow axis, an array of vapor flow elements is provided within the vapor producing chamber.

In the illustrated embodiment, the system further comprises an independent solvent condensate recovery chamber for collecting liquid mixture recovered from the vessel interior during the solvent vapor cleaning cycle. The system also includes a plurality of vapor filtration units and flow control devices which when operably configured with the vapor delivery and recovery tubes and the ports of the solvent vapor producing chambers, simultaneously permits vapor cleaning of two or more vessel interiors and the subsequent evacuation of residual solvent vapors in a safe, environmentally acceptable manner.

BRIEF DESCRIPTION OF THE DRAWINGS

For a more complete understanding of the objects of the present invention, the following detailed description of the illustrated embodiment is to be taken in conjunction with the drawings, in which.

DETAILED DESCRIPTION OF ILLUSTRATIVE EMBODIMENT

Figure 1:
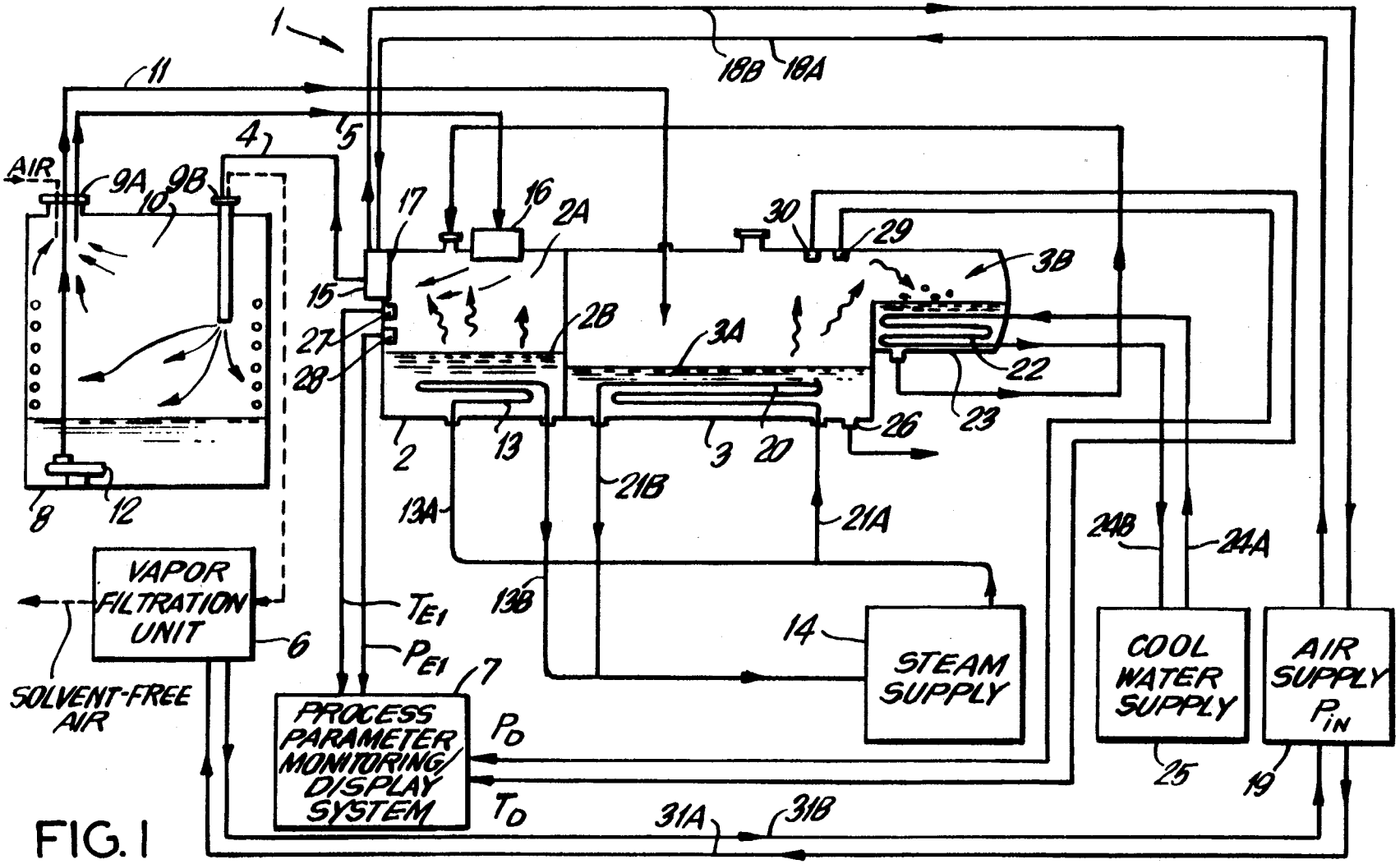
FIG. 1 is a schematic diagram illustrating the integration of the various components comprising the vessel cleaning system according to the present invention.
Figure 3:
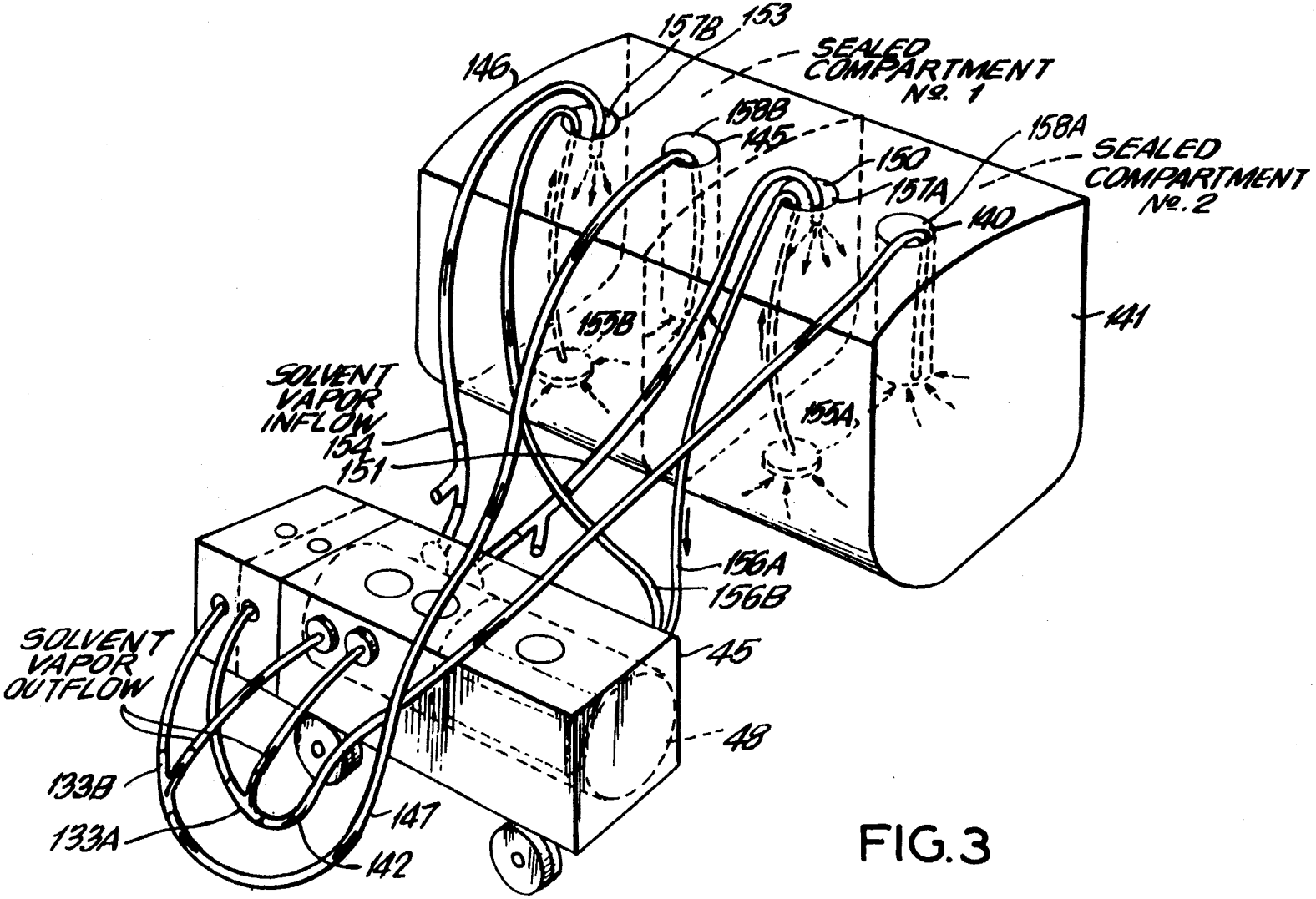
FIG. 3 is a schematic representation of the oil tanker and transportable vessel cleaning system operably configured in FIG. 2, illustrating the flow of recirculated solvent vapor and recovered solvent vapor condensate during a solvent vapor cleaning cycle according to the present invention.
Figure 3A:
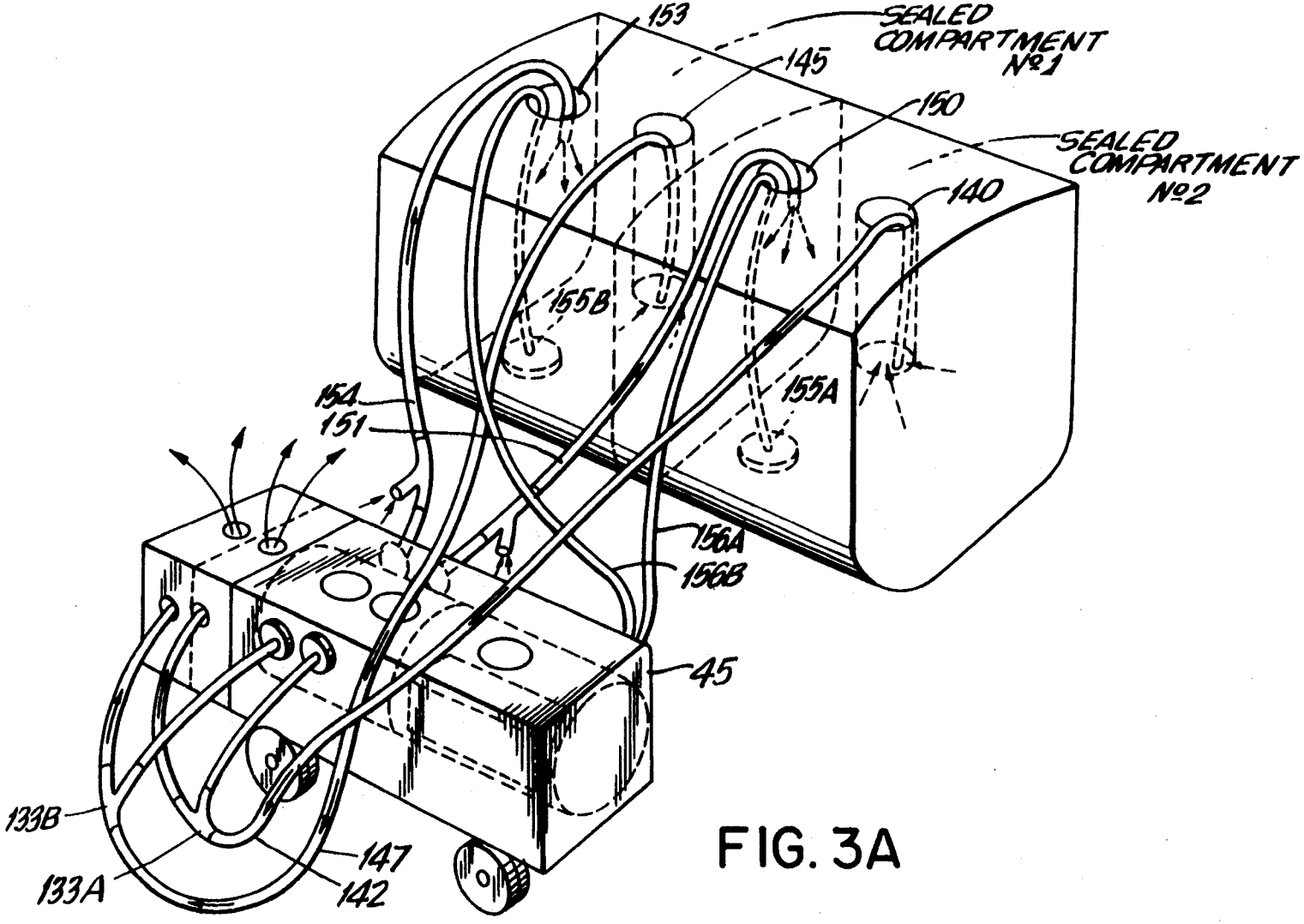
FIG. 3A is a schematic representation of the oil tanker and transportable vessel cleaning system operably configured in FIG. 2, illustrating the flow of air and residual solvent vapor during a solvent vapor evacuation cycle according to the present invention.

The vessel cleaning system of the present invention, schematically represented in FIGS. 1, 3 and 3A and graphically shown throughout the other drawings, is capable of carrying out several distinct operations. As will become apparent hereinafter, these operations can be sequenced in a variety of ways to perform one or more multi-cycle vessel cleaning processes. To greater appreciate the structure and function of the system to be described, the cycles (i.e. operations) of an exemplary cleaning process will first be described.

In some applications, vapor emitted from residual deposits on the interior surfaces of an emptied vessel, must be first evacuated during a deposit vapor evacuation cycle. As will be described in great detail hereinafter, this cycle involves removing deposit vapors from the sealed vessel interior, while filling it with ambient air. The residual deposit can be subsequently removed from the interior surfaces of the sealed vessel during a solvent vapor cleaning cycle. This cycle involves recirculating a solvent vapor stream through the sealed vessel interior, while recovering from the bottom of the vessel, condensed solvent vapor and contaminant material. Thereafter, residual solvent vapor within the vessel interior is withdrawn and filtered and the cleaned vessel interior filled with ambient air. Upon completion of the solvent vapor evacuation cycle, the sealed vessel can be opened and workers may safely enter the vessel interior to inspect the cleaned interior surfaces. Notably, during each cycle of the process, the vessel interior is substantially sealed to prevent release of deposit or solvent vapor to the ambient environment.

Referring now to FIG. 1, vessel cleaning system 1 of the present invention generally comprises a number of components, namely: a solvent vapor producing chamber 2, a solvent condensate recovery chamber 3, a vapor delivery tube 4, a vapor recovery tube 5, a vapor filtration unit 6, and instrumentation 7 for monitoring and displaying process parameters, such as vapor pressure and temperature within the solvent vapor producing chamber and the solvent condensate recovery chamber. As illustrated, the interior surfaces of an emptied vessel 8 (e.g. a ship storage compartment, land tank, or the like) are coated with residue deposit and/or protective coating (as the case may be), and require cleaning. Typically, such vessels will have at least two spatially separated access ports 9A and 9B through which solvent vapor can be simultaneously introduced into, and withdrawn from, the sealed vessel interior 10. Notably, one of these access ports can be used to pass a flexible tube 11 through the sealed vessel interior. One end of the flexible tube is connected to an inlet formed through solvent condensate recovery chamber 5, while the other end of the tube is connected to the outflow port of a diaphragm pump 12 installed at the bottom of the sealed vessel. Preferably, the pump is air powered and has a Teflon TM diaphragm which resists corrosive effects of the liquid mixture recovered from the bottom of the vessel during the solvent vapor cleaning cycle.

As schematically illustrated in FIG. 1, solvent vapor producing chamber 2 has a solvent reservoir portion 2A and a vapor collecting portion 2B. The solvent reservoir portion is adapted to contain a volume of vaporizable solvent in liquid state. Solvents which can be used to practice the present invention include, but are not limited to, chlorinated aliphatic (typically lower aliphatic) liquids such as methylene chloride, trichloromethane, trichloroethylene, ethylene dichloride and perchloroethylene. It has been found that perchlorethylene and/or blends of perchloroethylene and trichloroethylene are particularly desirable solvents due to their ability to clean a wide variety of chemical residues and their safety characteristics, e.g. high flash point. When practicing the vapor cleaning process of the present invention, particular solvents or blends thereof, have been found most effective. For example, perchloroethylene is effective in removing hydrocarbon coatings or residue deposits. A blend of perchloroethylene and trichloroethylene is highly effective in degreasing surfaces, whereas a blend of perchloroethylene and methylene chloride is effective in removing paint coatings.

As will become apparent hereinafter, a major benefit of vessel cleaning process of the present invention is that it is highly acceptable in environmental terms. Solvents used in practicing the present invention are recyclable during the solvent vapor cleaning cycle; evacuated solvent vapors are disposed of in an environmentally acceptable manner during the solvent vapor evacuation cycle; and chemical residue recovered from the vessel interior is collected for proper disposal.

In order to heat the solvent to form solvent vapor, a solvent heating unit 13 is disposed within the solvent reservoir portion. In the illustrated embodiment, the solvent heating unit comprises a heat exchanging tube structure through which low pressure steam is circulated by steam supply and return lines 13A and 13B which are connected to a steam supply 14. While the steam supply may be provided as part of the vessel cleaning system, it will be preferred in many applications to use a steam supply available at the site of the vessel.

While not illustratable in FIG. 1, the vapor producing chamber of the present invention includes solvent vapor outflow and inflow ports 15 and 16, which are both disposed along a vapor flow axis that extends through these ports and the vapor collecting portion of the chamber. In order to establish a closed vapor communication loop between the sealed vessel interior and the solvent vapor producing chamber, vapor delivery and recovery tubes 4 and 5 are connected to the solvent vapor outflow and inflow ports, as shown. To forcibly transport solvent vapor through the closed vapor communication loop, a vapor transporting unit 17 is operably associated with at least one of the solvent vapor outflow and inflow ports. As will be described in great detail hereinafter, the vapor transporting unit of the illustrative embodiment is an air-powered turbine fan installed within the flow channel of the solvent vapor outflow port. The blade assembly of the turbine fan is driven by circulating pressurized air through its turbine motor. Pressurized air is provided through air supply and return lines 18A and 18B connected to an air supply 19, provided as part of the vessel cleaning system or available at the vessel site.

As illustrated in FIG. 1, solvent vapor condensate recovery chamber 3 comprises a liquid mixture reservoir portion 3A and a solvent vapor condensing portion 3B in vapor communication with the interior of the solvent vapor recovery chamber. During the solvent vapor cleaning cycle, the liquid mixture consisting of solvent condensate and dissolved deposit material is pumped from the bottom of the sealed vessel, into the solvent condensate recovery chamber. In order to vaporize the liquid mixture, a liquid mixture heating unit 20 is disposed in the liquid mixture reservoir portion. In the illustrative embodiment, liquid mixture heating unit 20 is a heat exchanging tube structure through which steam is circulated through steam supply and return lines 21A and 21B connected to the steam supply.

The solvent vapor condensing portion of recovery chamber 3 has a cooling unit 22 disposed therein. Below this cooling unit, a solvent condensate collection reservoir 23 is provided for collecting solvent vapor condensate formed by cooling circulating solvent vapor about the cooling unit. In the illustrative embodiment, cooling unit 22 is realized as a heat exchanging tube structure through which cool water is circulated by water supply and return lines 23A and 23B connected to a water supply 25, preferably provided at the vessel site.

As the liquid mixture in the solvent vapor condensate recovery chamber is heated to the boiling point of the solvent, solvent vapor forms, circulates about cooling unit 22 and liquefies into solvent vapor condensate which is collected in solvent condensate collection reservoir 23. As illustrated, collection reservoir 23 is positioned above the solvent level in solvent vapor producing chamber 2, so that solvent vapor condensate can be released into solvent reservoir 2B by way of a gravity feed mechanism in order to maintain the solvent level during the solvent vapor cleaning cycle. Resinous material remaining at the bottom of the liquid mixture reservoir 3A after all solvent therein has been vaporized and condensed, can be withdrawn through a drainage port 26, stored in suitable containers and transported to a treatment facility for treatment well known in the art. As contaminated solvent condensate in liquid mixture reservoir portion 3A is physically isolated from the solvent vapor producing chamber and the solvent heating unit, only pure solvent contacts the interior surfaces of the solvent vapor producing chamber, minimizing maintenance and cleaning of this chamber. This feature is important, as in the operative embodiment to be described hereinafter there are various structural elements which would otherwise be fouled by contaminated solvent recovered from the vessel interior.

As illustrated in FIG. 1, instrument system 7 comprises a pair of pressure and temperature sensors 27 and 28, and 29 and 30, installed within the solvent vapor producing chamber and the solvent condensate recovery chamber, respectively. The function of these sensors (i.e. transducers) is continuously to measure during the solvent vapor cleaning process, the vapor pressure and temperature within each of these independent chambers and to generate signals representative of these temperature and pressure measurements. In the illustrative embodiment, these signals are transmitted over electrical lines to an instrument panel comprising a set of four display meters for visually displaying the measured vapor pressure and temperature measurements.

After carrying out a solvent vapor cleaning cycle, residual solvent vapor occupies the interior space of the sealed vessel. This residual solvent vapor is evacuated from the vessel during the subsequent solvent vapor evacuation cycle. As will be described in greater detail hereinafter, this cycle is initiated by performing a sequence of operations. First, steam and air supplies 14 and 19 are terminated by actuating, for example, hand or remotely actuatable valves. This operably disconnects the solvent vapor producing chamber from the vapor delivery and recovery tubes in order to prevent flow of solvent vapor from the solvent vapor producing chamber to the vessel interior. Vapor filtration unit 6 is then placed in vapor communication with the vessel interior, through the vapor recovery tube. Preferably, the vapor filtration unit comprises a vapor absorption element and an air-powered vacuum pump. In the illustrative embodiment, the vacuum pump is driven by circulating pressurized air through air supply and return lines 31A and 31B connected to the same pressurized air supply used to power the turbine fan. The vacuum pump also has an inflow port across which the solvent vapor absorption element is located, and an outflow port through which filtered air is exhausted.

During the initial phase of the solvent vapor evacuation cycle, the vacuum pump is driven by the air supply which creates a vacuum source along the vapor delivery tube. In response, the vacuum source forcibly transports solvent vapor within the vessel interior through the vapor delivery tube and the solvent vapor absorption element disposed at the inflow port of the vacuum pump. Solvent vapor is filtered out (and/or condenses) at the absorption element and air mixed with the solvent vapor is exhausted through the filtration unit outflow port to the ambient environment. After a substantial amount of solvent vapor has been evacuated from the vessel interior, air is permitted to enter the vessel interior, preferably by way of a flow control device installed in-line along the vapor recovery tube adjacent the solvent vapor inflow port. The vacuum pump is permitted to evacuate the vessel interior until it is substantially free of solvent vapor and is substantially filled with ambient air. At this stage, the vessel may be opened and safely entered by workers to inspect the interior surfaces.

Having generally described the vessel cleaning system process and system of the prevent invention with reference to the schematic representation of FIG. 1, it is appropriate at this juncture to describe the preferred embodiment of the vessel cleaning system with reference to FIGS. 2 through 14.

Figure 2:
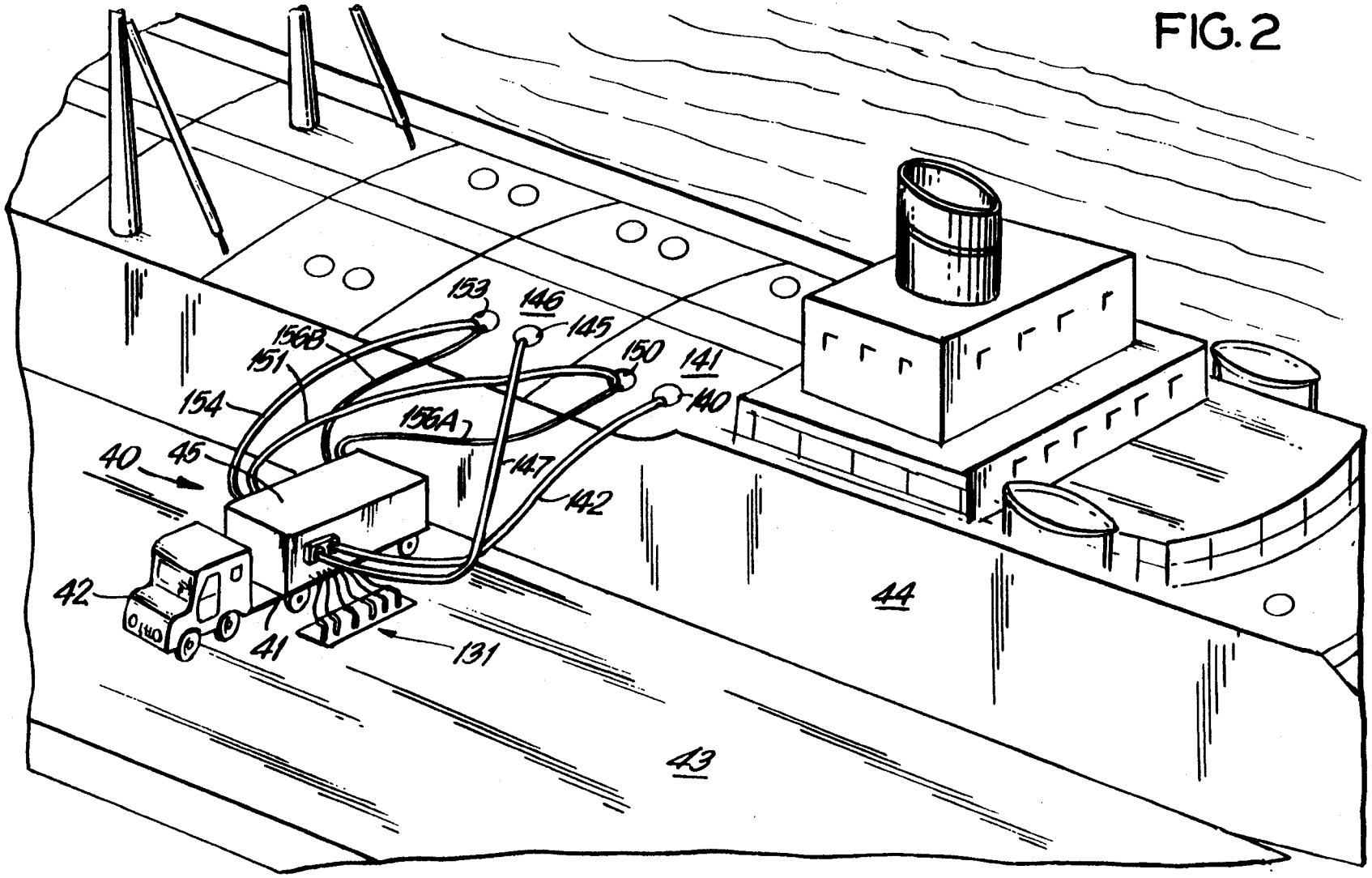
FIG. 2 is a partial perspective view of an unloaded oil tanker moored alongside the dock of a shipyard, at which the transportable vessel cleaning system of the present invention is operably configured with the interior access ports of two independent oil storage compartments, for the purpose of simultaneously removing residual oil coatings from the interior surfaces thereof.

As shown in FIG. 2, vessel cleaning system 40 is mounted on a platform or bed 41 of a trailer, which can be transported from one vessel site to another by a conventional tractor 42. For purposes of exposition, the site of illustrative embodiment is a dock 43 of a shipyard where an emptied oil tanker 44 is moored. To protect the operative components of the system from the natural elements and the like, an enclosure 45 (shown in phantom lines) is provided. As will be described in greater detail hereinafter, enclosure 45 has a number of openings through which access to various portions of the system can be achieved. As shown, each such opening is provided with a hinged door which can be opened and closed as required.

Figure 4:
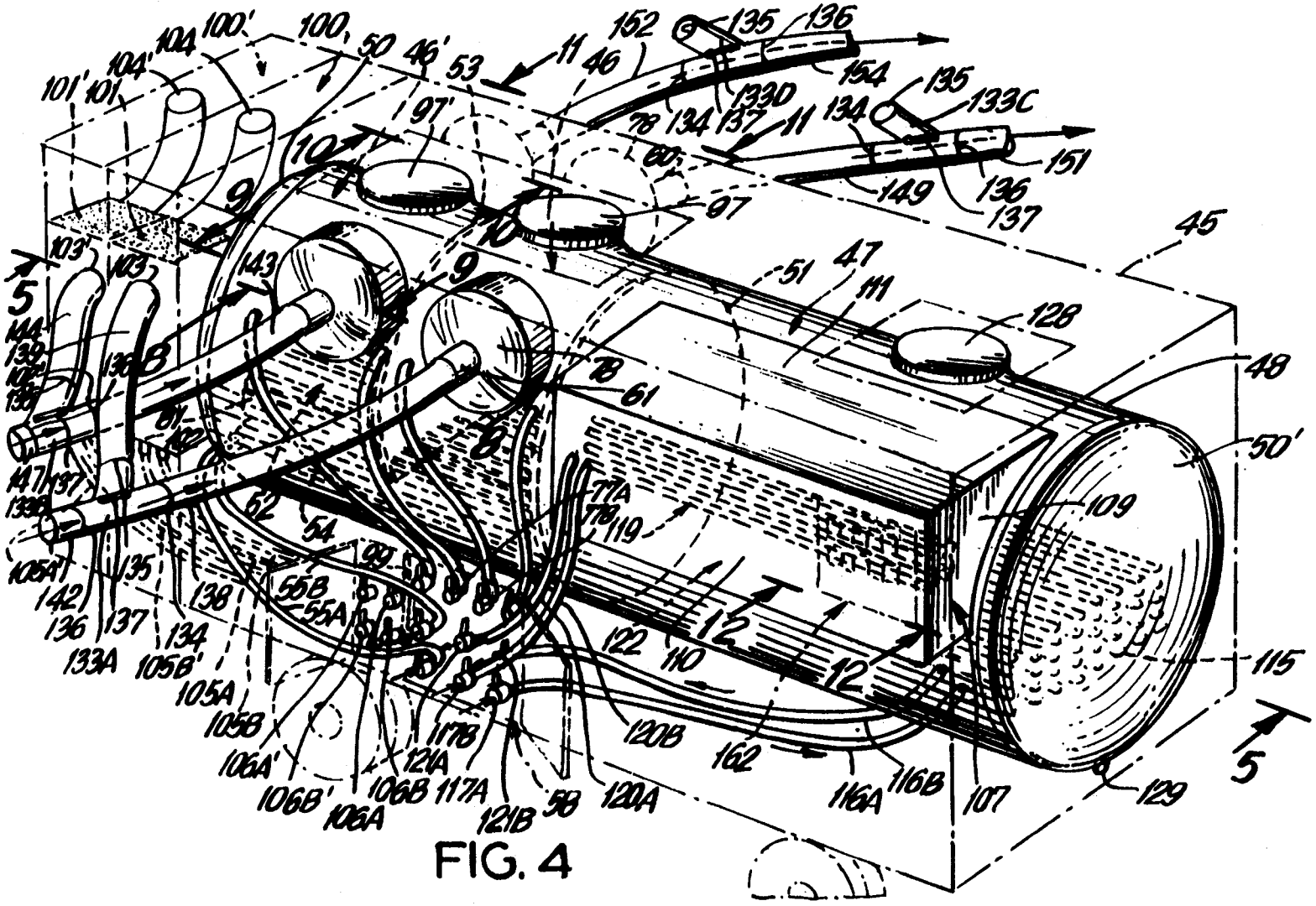
FIG. 4 is a perspective view of the transportable vessel cleaning system of FIG. 2, showing the vapor producing chamber, solvent condensate recovery chamber, and vapor filtration units arranged on the transportable platform and operably configured for a solvent vapor cleaning cycle according to the present invention.
Figure 5:
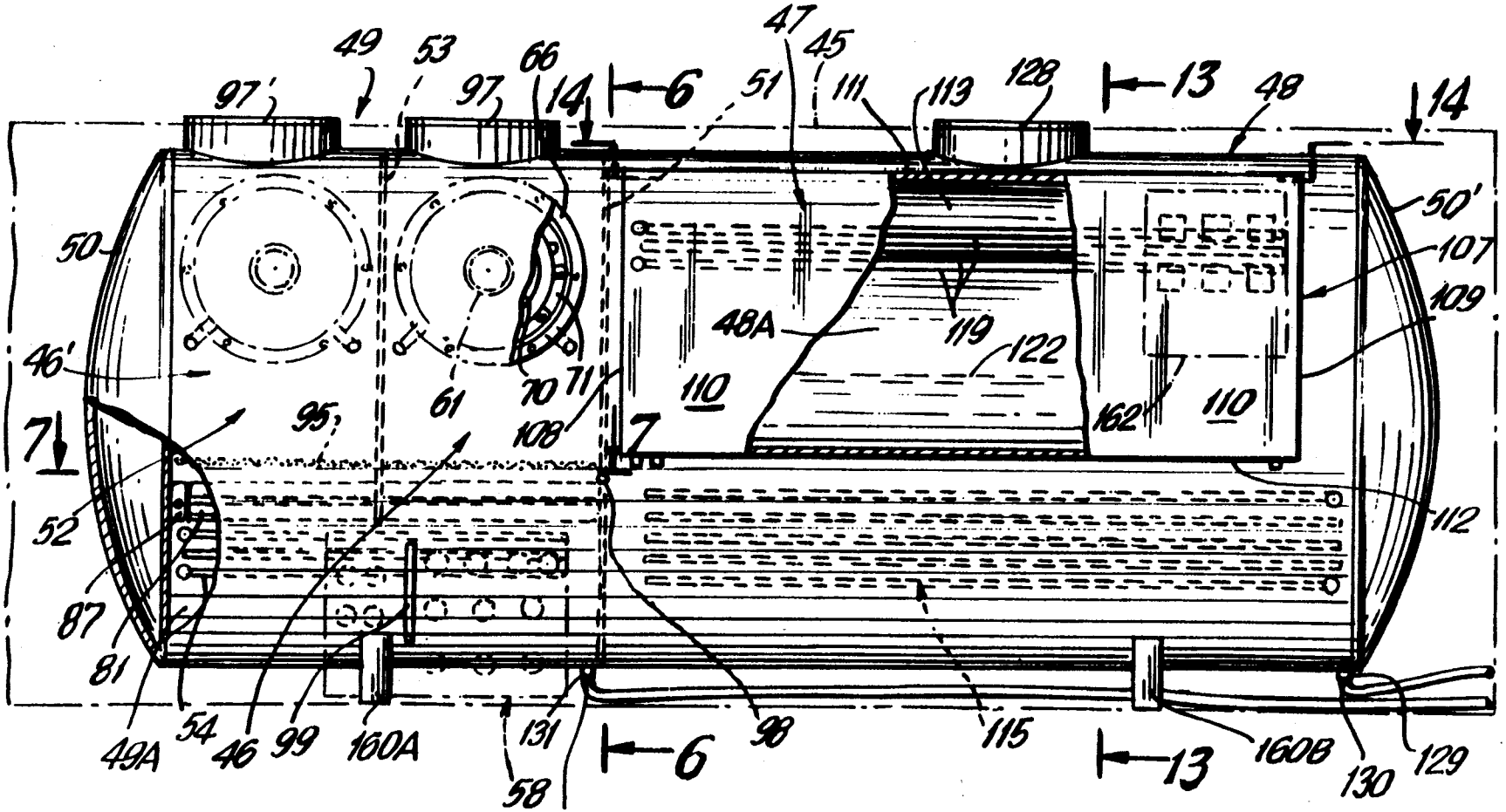
FIG. 5 is an elevated side view of the transportable vessel cleaning system of the illustrative embodiment, taken along line 5—5 of FIG. 4 showing the first and second solvent vapor outflow ports, and the solvent vapor condensing portion and solvent condensate collecting portion of the recovery chamber.

More clearly illustrated in FIGS. 4 and 5, transportable vessel cleaning system 40 comprises first and second solvent vapor producing chambers 46 and 46', and a solvent condensate recovery chamber 47. Each of these chambers, while being independently operable, is integrally formed with the wall surfaces of a large cylindrically shaped vessel 48. In the illustrative embodiment which is particularly designed for large scale vessel cleaning operations, the cross-sectional diameter of cylindrical vessel 48 is about 6 feet, having a length along its longitudinal extent of about 16 feet, although these dimensions will expectedly vary from embodiment to embodiment. Preferably, the cylindrical vessel is fabricated from stainless steel, although other suitable materials may be used to practice the invention.

As shown in FIGS. 4 and 5, a composite solvent vapor producing chamber 49 is formed between vessel end wall 50 having a slight surface curvature, and a circular partition wall 51 is welded to the interior surface of the cylindrical vessel. The length of the composite chamber along the longitudinal extent of cylindrical vessel 48 is about 6 feet. As illustrated, composite vapor producing chamber 49 includes a common solvent reservoir portion 49A for containing a volume of vaporizable solvent in liquid state, and a vapor collecting portion 52 which is defined as the interior space within the composite chamber, above the surface of liquid solvent in the reservoir portion.

Figure 6:
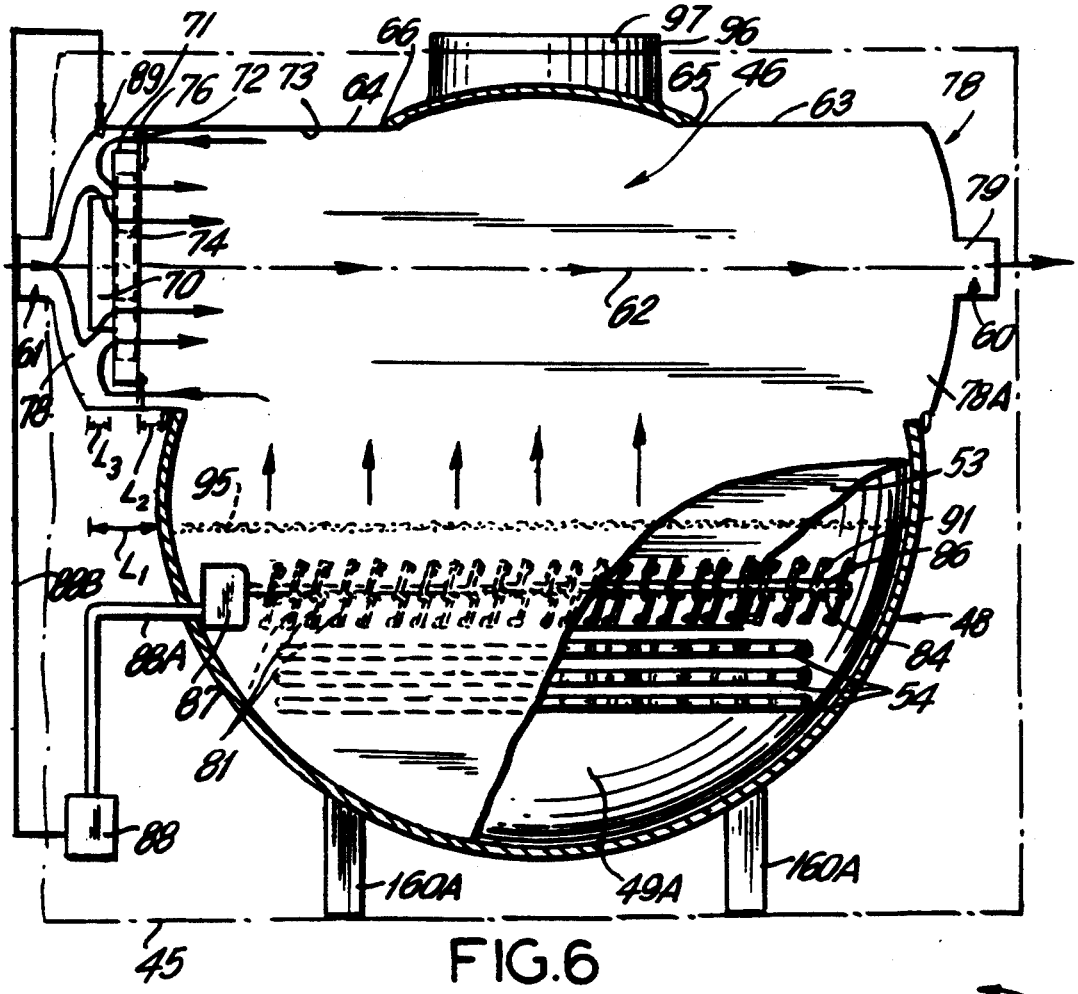
FIG. 6 is a cross-sectional view of the interior of the second vapor producing chamber, taken along line 6—6 of FIG. 5, showing the solvent vapor outflow and inflow ports aligned along the second vapor flow axis extending through the vapor collecting portion of the second solvent vapor producing chamber.

In the illustrative embodiment, first and second solvent vapor producing chambers 46 and 46' are formed within the composite chamber by welding a vapor isolating partition wall 53 to the interior surfaces of the composite chamber. As shown, the placement of partition wall 53 is at the midpoint between vessel end wall 50 and circular partition wall 51. In order to employ a common solvent heating unit for the first and second solvent vapor chambers, partition wall 53 does not extend into solvent reservoir portion 49A. As shown in FIGS. 5 and 6, this arrangement permits installation of a multiple level heat exchanging tube structure 54 within solvent reservoir portion 49A, slightly beneath the bottom edge of partition wall 53. In the illustrated embodiment, tube structure 54 comprises three levels of tubing, preferably fabricated from stainless steel tubing. In order to circulate steam through tube structure 54, steam supply and return pipes 55A and 55B are connected to the open ends of tube structure 54, extend through cylindrical vessel 48 in a sealed manner, and terminate with steam supply hose connectors (i.e. fittings) 56A and 56B, each having a hand-actuatable control valve 57. As illustrated in FIG. 4, steam supply hose connectors 56A and 56B are mounted through a service panel 58 which is accessible through an opening in the enclosure. As will be described in greater detail hereinafter, while first and second solvent vapor producing chambers share a common solvent heating unit, each chamber is otherwise operably independent and in vapor isolation from each other.

As illustrated in FIGS. 4, 5 and 6, the first solvent vapor producing chamber is provided with a first solvent vapor outflow port 60 and a first solvent vapor inflow port 61. As shown, both of these ports are disposed along a first vapor flow axis 62 which extends through both these ports and vapor collecting portion 46 of the first solvent vapor producing chamber. First solvent vapor outflow and inflow ports 60 and 61 are connected to cylindrically shaped flow channels 63 and 64, respectively, which are coaxially aligned along the first vapor flow axis and pass through and are welded at apertures 65 and 66 formed through cylindrical vessel 48. As shown, axially aligned vapor flow channels 60 and 61 are arranged substantially orthogonal with respect to the longitudinal extent of the cylindrical vessel.

Figure 8:
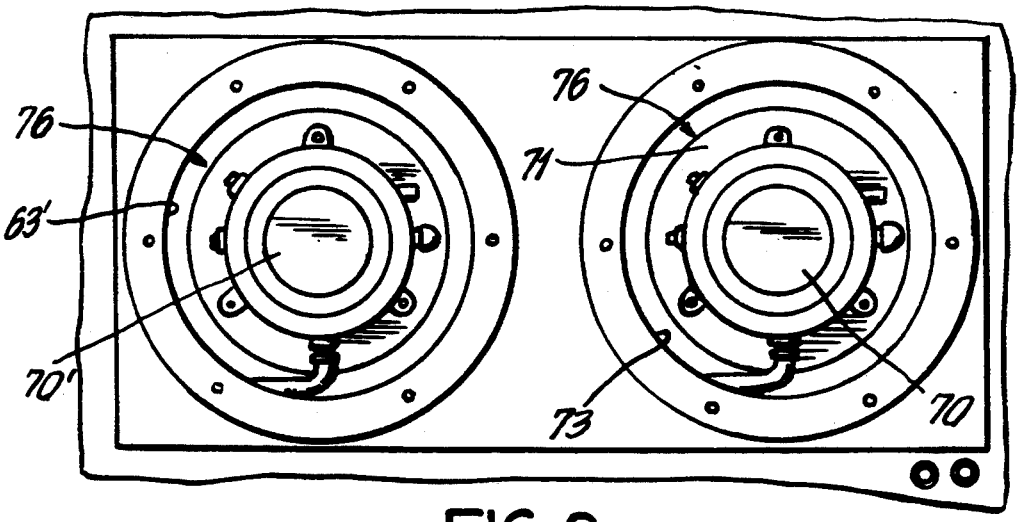
FIG. 8 is a partially broken away elevated side view of the first and second solvent vapor producing chambers, taken along line 8—8 of FIG. 4, showing the first and second turbine fan units mounted within the flow channel of the first and second solvent vapor outflow ports, respectively.
Figure 9:
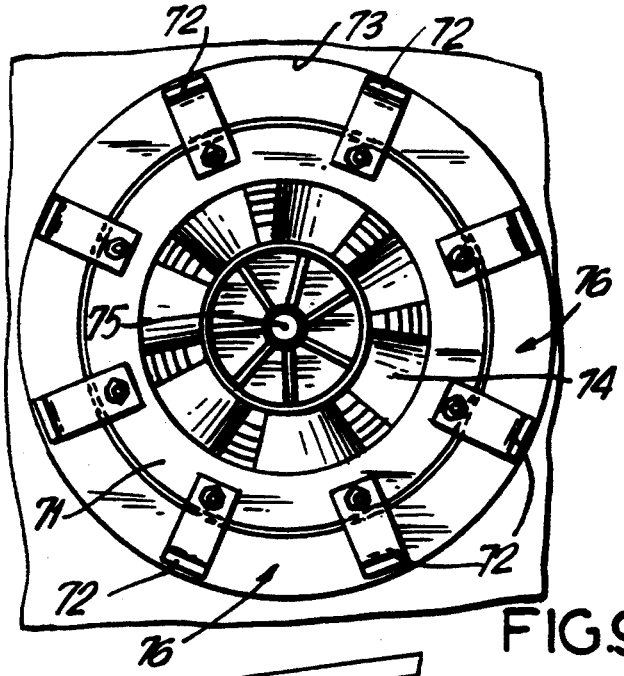
FIG. 9 is an axial view of the first solvent vapor producing chamber, taken along line 9—9 of FIG. 4, showing the fan blade assembly of the first turbine fan unit coaxially mounted within the flow channel of the first solvent vapor outflow port.
Figure 10:
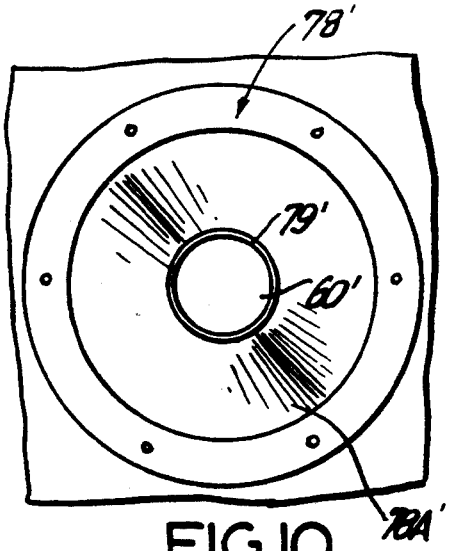
FIG. 10 is an axial view of the first vapor producing chamber taken along line 10—10 of FIG. 4, showing the flow channel coaxially aligned along the first vapor flow axis and converging towards the first solvent vapor inflow port.

As shown in FIGS. 6 and 9, in particular, an air-powered turbine fan 70 is mounted axially within the end portion of the flow channel of solvent vapor inflow port 61. As shown in FIG. 8, turbine motor housing 71 of fan 70 is supported inflow channel 64 by a plurality of radially extending flanges 72 which are welded onto the interior surface 73 of the flow channel. Circumferentially arranged holes in turbine motor housing 71 are aligned with holes formed in each of the radially extending flanges, and a bolt is passed through each pair of spatially aligned holes to securely support the turbine fan within the flow channel. When installed, the axis of rotation of fan blade assembly 74 and turbine motor shaft 75 to which it is connected, will be aligned along the first vapor flow axis of the first solvent vapor producing chamber, providing an annular vapor flow passageway 76 between cylindrical interior channel wall surface 73 and turbine motor housing 71, as shown in FIGS. 6, 8 and 9.

In order to drive turbine motor 70 with pressurized air, air supply and return lines 76A and 76B are connected to inflow and outflow ports of the turbine motor and terminate with air supply hose connectors 77A and 77B, respectively, each having a hand-actuatable control valve. As shown, air supply hose connectors 77A and 77B are mounted through service panel 58 for easy access at the vessel site.

Figure 11:
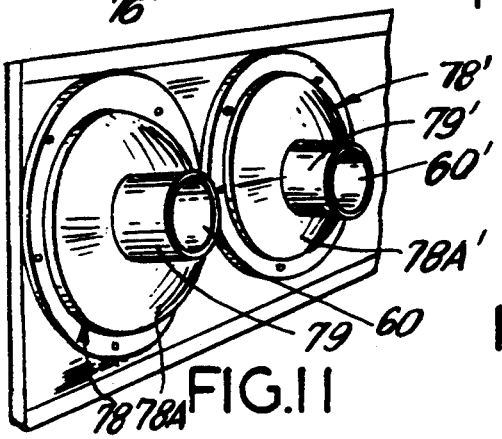
FIG. 11 is a perspective of the first and second solvent vapor inflow ports, taken along line 11—11 of FIG. 4.

As clearly illustrated in FIGS. 4, 6 and 11, solvent vapor outflow and inflow ports 60 and 61 each have an aerodynamically contoured flow channel adapter 78 for coupling flexible vapor delivery and recovery tubes to vapor flow channels 63 and 64, respectively. As the flow channels have a substantially larger diameter than the flexible vapor delivery and recovery tubes, flow diameter reduction must be achieved while minimizing flow resistance and accompanying vapor pressure drops at the flow channel adapters. In the illustrative embodiment, flow channel diameter reduction has been achieved by providing a transition channel 78A having an elliptical surface curvature over a length of about 12 inches along the vapor flow axis. To fasten the vapor delivery and recovery tubes to respective solvent vapor flow ports, each flow channel adapter 78 has a cylindrical collar 79 over which the open end of one of these tubes can be slid and secured with a circumferentially enveloping fastener well known in the art.

In the illustrated embodiment, the diameter of cylindrical flow channel 76 is about 26 inches and the outer diameter of turbine motor housing 71 about 21 inches, providing vapor flow passageway 76 with a width dimension of about 3.5 inches. The diameter of fan blade assembly 74 is about 14.5 inches. As the width (i.e. depth) of turbine motor housing 71 is about 15.0 inches in the illustrated embodiment, the length $L_1$ of flow channel extending beyond aperture 66 is selected to be about 19.0 inches so that the inner and outer setback distances $L_2$ and $L_3$ are each about 2.0 inches.

With vapor transport arrangement of the present invention, a number of important functions can be carried out during the vapor cleaning cycle. Rotation of fan blade assembly 74 creates a vacuum source on the intake side of the turbine fan unit. Fresh solvent vapor filling the solvent vapor producing chamber and collecting about the upper and lower zones of flow channel 63 will automatically be drawn through annular vapor flow passageway 76 and into the intake (i.e. vacuum source) side of turbine fan 70, as schematically illustrated in FIG. 6 by directional arrows. Simultaneously, recovered solvent vapor and/or air flowing through solvent vapor inflow port 61 mixes with solvent vapor drawn from the vapor collecting portion of chamber 46 and through annular vapor flow passageway 76. As shown in FIG. 6, the combined vapor flow passes through turbine blade assembly 74 towards the outflow port along the flow axis. Advantageously, the vapor transport arrangement ensures that during the initial stage of the solvent vapor cleaning cycle, air drawn from the sealed compartment interior mixes with solvent vapor at the intake side of the turbine fan unit. Also, during steady state operation of the cycle, low temperature recovered solvent vapor mixes with high temperature solvent vapor at the intake side of the turbine fan unit. Additionally, owing to the cylindrical nature of vapor collecting portion of each solvent vapor producing chamber, solvent vapor is not permitted to "hide" within each chamber and thus maximum vapor throughput is ensured.

Figure 7:
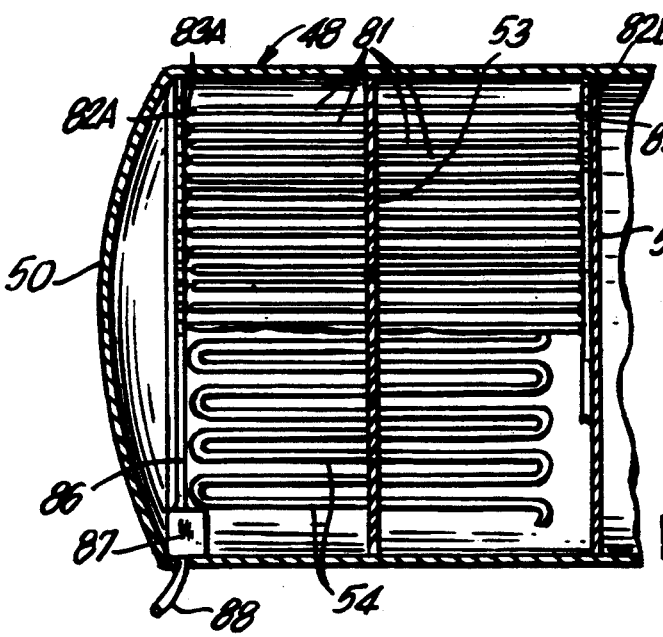
FIG. 7 is a partially broken away view of the interior of the first solvent vapor producing chamber, taken along line 7—7 of FIG. 5, showing the plurality of vapor baffle elements installed above the solvent heating unit.
Figure 6A:
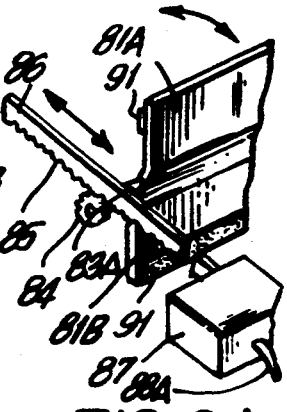
FIG. 6A is a perspective view of a mechanism for controlling the position of the vapor buffle elements.

As illustrated in FIGS. 6, and 7, a plurality of vapor baffle elements 81 are mounted slightly above the upper level of tube structure 54 within both the first and second solvent vapor producing chambers. As illustrated, each vapor baffle element has a blade-like structure having an upper blade portion 81A parallel to, yet slightly offset from a lower blade portion 81B. These vapor baffle elements are spatially arranged in a parallel fashion substantially orthogonal to the direction of the vapor flow axis. In order that vapor baffle elements 81 may control the flow of solvent vapor into each solvent vapor producing chamber, each vapor baffle element is rotatably mounted between end support bars 82A and 82B. As shown, each vapor baffle element 81 has end projections 83A and 83B which fit into one of a plurality of evenly spaced holes formed in support bars 82A and 82B, as shown. In order to selectively rotate each vapor baffle element 81 in an orchestrated manner, each end projection 83A has teeth 84 which are engaged by projections 85 periodically formed along an actuation bar 86 which is coupled to a hydraulic piston 87, mounted as shown. Piston 87 is connected to a hydraulic controller 88 by way of fluid line 88A.

In order to configure the vapor baffle elements into a closed overlapping position, which would be desired, for example, during an emergency or shut down situation, controller 88 provides piston 87 with hydraulic fluid so as to displace activation bar 86 in a direction which causes the vapor baffle elements to rotate into a downward position. A controller overdrive unit (not shown) operably associated with controller 88 can be provided so that the operator can manually actuate controller 88 to achieve this closed configuration during emergency or shut down situations. Notably, each vapor baffle element 81 is provided with gasket seals 91 so that when disposed in this overlapping closed position, a vapor seal is established between each contiguous vapor baffle element.

In order to configure the vapor baffle elements in a parallel, substantially upstanding arrangement as shown in FIG. 6, controller 88 provides piston 87 with hydraulic fluid so as to displace actuation bar 86 in the opposite direction, causing the vapor baffle elements to rotate into an upstanding position, as shown in FIG. 6. In this open configuration, the vapor baffle elements collectively permit upwardly rising solvent vapor to flow between the transversely arranged openings provided between the vapor baffle elements, while reducing entrainment of liquid solvent within the upward flow of solvent vapor, as a recirculating stream of solvent vapor is forcibly transported along the vapor flow axis. The vapor baffle elements can be configured to any position between the open upstanding and closed overlapping configurations by providing piston 87 with a different amount of hydraulic fluid.

In order to sense the degree of solvent saturation in the solvent vapor stream, relative humidity sensor 89 is installed at the solvent vapor inflow port 61 through flow channel 64, as shown. Notably sensor 89 can be an instant action anemometer capable of making velocity, temperature and relative humidity measurements within the solvent vapor inflow port. In the illustrative embodiment, relative humidity measurements are used to measure the degree of solvent vapor saturation in the solvent vapor stream. Signals representative of such measurements are provided to hydraulic controller 88 over line 88B so as to control the position of the vapor baffle elements, as in a manner described below.

During initial stage of the solvent vapor cleaning cycle when the solvent vapor stream is not saturated, the relative humidity measurements from sensor 89 will cause the hydraulic controller to transmit hydraulic fluid to piston 87 so as to fully open the vapor baffle elements. When full saturation is attained during the steady state portion of the cleaning cycle, relative humidity measurements from sensor 89 will cause hydraulic controller 88 to partially close the vapor baffle elements. This damping action limits the upward flow of solvent vapor while permitting sufficient heat flux to heat the solvent vapor stream in the solvent vapor producing chamber. During steady state operation, solvent vapor will be continuously recirculated through the closed system, with heat being added to the solvent vapor stream as it continuously passes through the solvent vapor producing chamber. As the solvent vapor within the system is being continuously reheated, the rate of solvent vapor condensation within the compartment interiors will decrease, thus minimizing the amount of solvent vapor that must be produced in order to maintain the solvent vapor stream at full saturation.

Typically, some portion of the solvent vapor passing through the vapor baffle elements will contain entrained solvent mist. In order to condense this entrained solvent mist while permitting dry solvent vapor to pass up into the recirculating solvent vapor stream, a vapor transmissive structure 95 is installed slightly above the vapor baffle elements. In the illustrative embodiment, vapor transmissive structure comprises a honeycomb-structured perforated screen fabricated from a thermally conductive material, such as stainless steel. Preferably, apertures formed in the screen have dimensions on the order of about 1/16 to about ¼ of an inch. Alternatively, vapor transmissive structure 95 can be realized by a mesh screen made of stainless steel. Mesh screen material suitable for this purpose is commercially available from Bethlehem Steel Corporation of Bethlehem, Pa. Preferably, all structural elements disposed within each solvent vapor producing chamber are made from stainless steel so as to withstand corrosive effects of solvent vapor.

To permit access to the interior of the first solvent vapor producing chamber, an access port 96 is formed in the upper portion of cylindrical vessel 48 above each vapor collecting portion. Access port 96 is provided with a hatch cover 97 which can be closed shut during system operation to provide a vapor seal about the access opening. Through the side wall of cylindrical vessel 48 slightly above vapor baffle elements 81, an opening 98 is provided for filling, as required, the solvent reservoir portion with solvent condensate recovered from the solvent condensate recovery chamber. This feature will be discussed in greater detail hereinafter. In order to precisely monitor the level of solvent in the solvent reservoir portion, a sight glass 99 is provided through the side wall of cylindrical vessel 48. As it is important to restrict the solvent level below the upper level of heat exchange tubing 54, which functions to "dry" upwardly rising solvent vapor, the range of the sight glass preferably extends from the bottom of vapor baffle elements 81 to below the lowermost level of heat exchanging tube structure 54.

The structure and function of the second solvent vapor producing chamber is identical to that of the first solvent vapor producing chamber. As such, parts of the second solvent vapor producing chamber that are identical to described parts of the first solvent vapor producing chamber, are referenced in the drawings using similar reference numbers followed by the symbol "'".

Returning to FIG. 4, first and second solvent vapor filtration units 100 and 100' are mounted onto transportable platform 41, as shown. Each vapor filtration unit comprises a vapor absorption element 101, 101' (e.g., a granular activated charcoal filter) and an air-powered vacuum pump 102, 102' having an inflow port 103, 103' and an outflow port 104, 104'. Vacuum pump 102, 102' includes a turbine motor having air inflow and outflow ports which are connected to air supply and return lines 105A, 105A', and 105B, 105B', and terminate with air hose supply connectors 106A, 106A', and 106B, 106B', mounted through service panel 58. As pressurized air is circulated through these lines, the turbine motor is driven and a vacuum source is created at the inflow port of the vacuum pump. As absorption element 101, 101' is installed across the flow path through the inflow port, and solvent vapor drawn through the vacuum pump is filtered out in an environmentally acceptable manner. Vapor filtration devices using granular activated carbon absorption technology suitable for use in practicing the present invention are commercially available from the Calgon Carbon Corporation of Pittsburgh, Pa.

Figure 13:
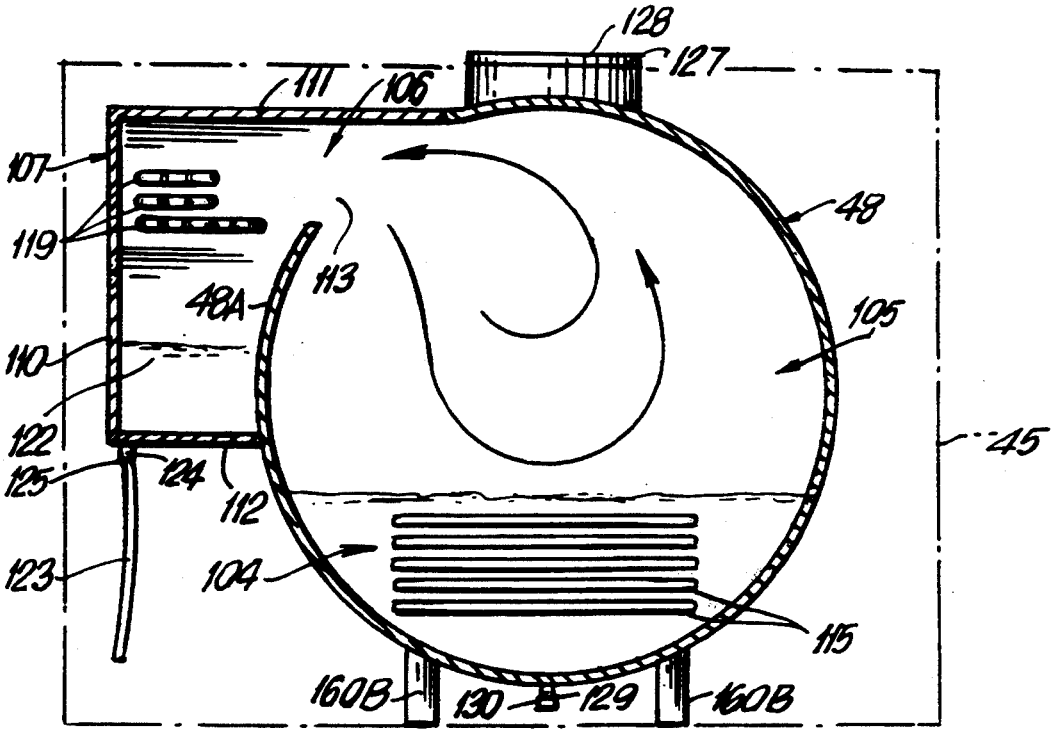
FIG. 13 is a cross-sectional view of the interior of the solvent condensate recovery chamber, taken along line 13—13 of FIG. 5, showing the liquid mixture reservoir portion and the solvent vapor condensing portion thereof.
Figure 14:
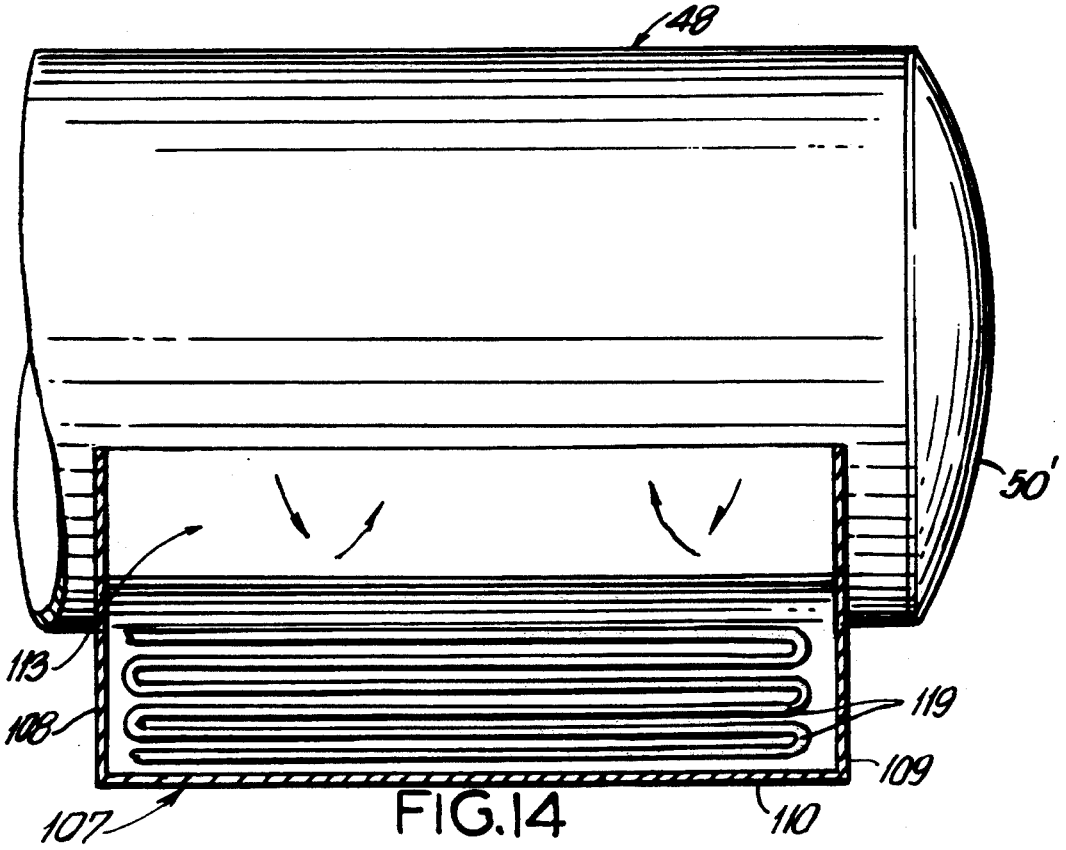
FIG. 14 is a plan, partial cross-sectional view of the solvent condensate recovery chamber, taken along line 14—14 of FIG. 5.

As shown in FIGS. 4 and 5, the interior volume of solvent condensate recovery chamber 47 is bounded at one end by cylindrical partition wall, and at its other end by vessel end wall 50, which has a small surface curvature. In the illustrative embodiment, the length of the solvent condensate recovery chamber is about 10 feet. Solvent condensate recovery chamber 47 has a liquid mixture reservoir portion 104, a solvent vapor collecting portion 105, and a solvent vapor condensing portion 106. The liquid mixture reservoir portion is adapted to contain a volume of liquid mixture recovered from the bottom of the sealed vessel during the solvent vapor cleaning cycle. As clearly illustrated in FIGS. 5, 13 and 14, solvent vapor condensing portion 105 is realized as an elongated box-like condenser housing 107, which is welded to the upper outer side wall surface of the cylindrical vessel. As shown, condenser housing 107 has side wall panels 108, 109, and 110, and top and bottom panels 111 and 112. In order that interior space 106 of the condenser housing is in vapor communication with the interior of solvent vapor collecting portion 105, an elongated vapor flow aperture 113 is formed through cylindrical side wall surface 48A, along the length of the condenser housing, as shown in FIGS. 13 and 14. Elongated aperture 113 permits solvent vapor forming in the recovery chamber to flow upwardly and circulate within housing 107.

As shown in FIGS. 5 and 13, a multi-level heat exchanging tube structure 115 is disposed within reservoir portion 104 for the purpose of heating the liquid mixture to a suitable temperature to vaporize the solvent contained therein. In order to circulate a heat conductive medium, such as steam, through tube structure 115, steam supply and return lines 116A and 116B are connected to the inflow and outflow ports of the tube structure and terminate with steam supply hose connectors 117A and 117B, respectively, each having a hand-actuatable control valve. Steam supply hose connectors 117A and 117B are mounted through service panel 58 for easy access.

In order to condense solvent vapor circulating within solvent vapor condensing portion 105, a multi-level heat exchanging tube structure 119 is disposed within condenser housing 107, at about the level of elongated vapor flow aperture 113, as shown in FIGS. 13 and 14. To circulate cool water through tube structure 119 and thereby lower its surface temperature below that of encirculating solvent vapor, cool water supply and return lines 120A and 120B are connected to the inflow and outflow ports of tube structure 119, and terminate with water hose connectors 121A and 121B, respectively, each having a hand-actuatable control valve. Water supply hose connectors 121A and 121B are mounted through service panel 58 along with all other hose connectors, for easy access. During solvent vapor distillation, solvent vapor condensate forming on the surface of tube structure 119, drips down into solvent condensate reservoir 122 which is formed as the lower portion of condenser housing 107. To selectively release collected solvent condensate into solvent reservoir 49A as needed, a tube 123 with a solvent flow control valve 124 is connected between port 98 in the cylindrical partition wall and drain port 125 formed in the bottom of solvent condensate reservoir 122. Preferably, solvent flow control valve 124 is also mounted through service panel 58 for easy access during solvent vapor cleaning operations.

As shown in FIG. 13, access to the interior of solvent condensate recovery chamber 47 is provided through port hole 127 which is closed off with a hatch cover 128 to provide a vapor seal during solvent distillation in the recovery chamber. Removal of residual resin and sludge from the bottom of the solvent condensate recovery chamber, can be achieved by removing drain plug 129 threaded through drain hole 130. Similarly, removal of solvent from solvent reservoir portion 51 can be achieved by removing a drain plug 131 threaded through drain hole 132 formed in the bottom of the cylindrical vessel. In order to ensure excess solvent and resinous sludge flows out through drain holes 132 and 130, respectively, cylindrical vessel 48 is mounted at an incline on platform 41 using support legs 160A and 160B.

Figure 12:
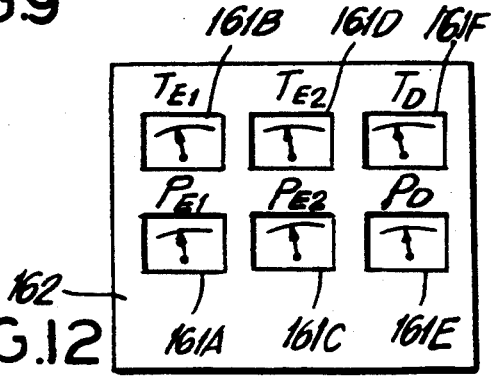
FIG. 12 is an elevated side view of the instrument panel of the transportable vessel cleaning system of the present invention, taken along line 12—12 of FIG. 4.

Monitoring the vapor pressure and temperature within the solvent vapor producing chambers and the solvent condensate recovery chamber is achieved by installation of sensors within these chambers in a manner described in connection with the system of FIG. 1. As shown in FIG. 12, meters 161A through 161F are mounted through instrument panel 162 accessible through an opening in the enclosure. These meters continuously display vapor pressure and temperature readings in respective chambers. Monitoring of solvent levels in reservoirs 49A and 104 can be achieved using site glasses or other fluid level indicating devices well known in the art.

Having described the structure and function of the transportable vessel cleaning system hereof, its setup and operation during the various cycles of the vapor cleaning process will now be described with reference to FIGS. 2, 3, 3A, 4 and 4A, in particular. For purposes of illustrating the present invention, the case of simultaneously cleaning the interior of two storage compartments of an emptied oil tanker, will be considered.

As illustrated in FIG. 2, vessel cleaning system 40 is transported to the site of the vessel to be cleaned, i.e. dock 43 where emptied oil tanker 44 is moored. At the vessel site, steam, pressurized air and water supplies 131 will typically be available, and if not, can be readily provided in a manner apparent to those skilled in the art. Suitable hoses 132 are used to connect these various supplies to corresponding connectors provided at the service panel, as hereinbefore described.

In the illustrative embodiment of the vessel cleaning system shown in FIGS. 2 and 4, configuration of the vapor delivery and recovery tubes between the solvent vapor producing chambers, the inflow ports of the vapor filtration units, and the access ports of the storage compartments involves installation of a vapor/air flow control device between each solvent vapor outflow and inflow port and the oil storage compartments. In general, each flow control device 133A, 133B, 133C and 133D has a Y-branch tube section which selectively permits only one of two flow ports 134 and 135 to communicate (i.e. pass) vapor and/or air to flow port 136 thereby providing two possible flow paths, i.e. a first flow path and a second flow path. In the illustrative embodiment, such flow control selection is achieved by rotatably mounting a circular baffle plate and appropriate gasket seals (not shown) within each flow control device. In operation, the baffle plate can be displaced to either a first or a second position by an externally disposed hand-actuatable lever 137. The first position of the lever corresponds to selection of the first flow path, whereas the second position of the lever corresponds to selection of the second flow path. The particular functions that each of these flow control devices performs during each cycle of the vessel cleaning process will be described hereinafter in connection with the operation of transportable vessel cleaning system 40.

As illustrated in FIG. 4, a number of vapor flow connections must be established on the service panel side of the transportable platform using flow control devices 133A and 133B. In particular, first solvent vapor inflow port 61 is connected to flow port 134 of flow control device 133A using a first short tube section 138, and the inflow port of first vapor filtration unit 100 is connected to flow port 135 of flow control device 133A using a second short tube section 139. Flow port 136 of flow control device 133A is, in turn, connected to access port 140 of first storage compartment 141 using a long flexible tube section 142, as shown in FIG. 3. Similarly, second solvent vapor inflow port 61' is connected to flow port 134 of flow control device 133B using a third short tube section 143, and the inflow port of second vapor filtration unit 100' is connected to flow port 135 of flow control device 133B using a fourth short tube section 144. Flow port 136 of flow control device 133B is, in turn, connected to access port 145 of second storage compartment 146 using a long flexible tube section 147, as shown.

On the other side of transportable platform 41, a number of vapor/air flow connections must be established using flow control devices 133C and 133D. In particular, first solvent vapor outflow port 60 is connected to flow port 134 of flow control device 133C using a fifth short tube section 149, and flow port 136 of this flow control device is connected to access port 150. of the first storage compartment using a long flexible tube section 151. Notably, flow port 136 of flow control device 133C is exposed to the ambient environment. Similarly, second solvent vapor outflow port 60' is connected to flow port 134 of flow control device 133D using a sixth short tube section 152, and flow port 136 of this flow control device is connected to access port 153 through the second storage compartment using long flexible tube section 154. Flow port 135 of this flow control device is also exposed to the ambient environment.

While or after connecting the vapor delivery and recovery tubes as described above, an air-powered teflon diaphragm pump 155A, 155B is placed at the bottom of each oil storage compartment. The mixture recovery tube 156A, 156B connected to the outflow port of each pump 155A, 155B and the air supply and return lines thereto (not shown), are then passed through designated holes formed through cover plates 157A, 157B which are used to close shut access ports 150 and 153, respectively, in a vapor sealed manner. Solvent vapor delivery tubes 151 and 154 are connected to port holes formed in cover plates 157A and 157B, respectively, to establish a first vapor communication pathway between each solvent vapor producing chamber and compartment interior. Cover plates 158A and 158B are also placed over access ports 150 and 145 to close shut these access ports in a vapor sealed manner. Finally, solvent vapor recovery tubes 142 and 147 are connected to port holes formed in cover plates 158A and 158B to establish a second vapor communication pathway between each solvent producing chamber and compartment interior. At this stage, both storage compartments are substantially sealed off from the ambient environment. Having performed the above procedure, the vessel cleaning system is configured for operation.

OPERATION OF THE ILLUSTRATIVE EMBODIMENT DEPOSIT VAPOR EVACUATION CYCLE

Figure 4A:
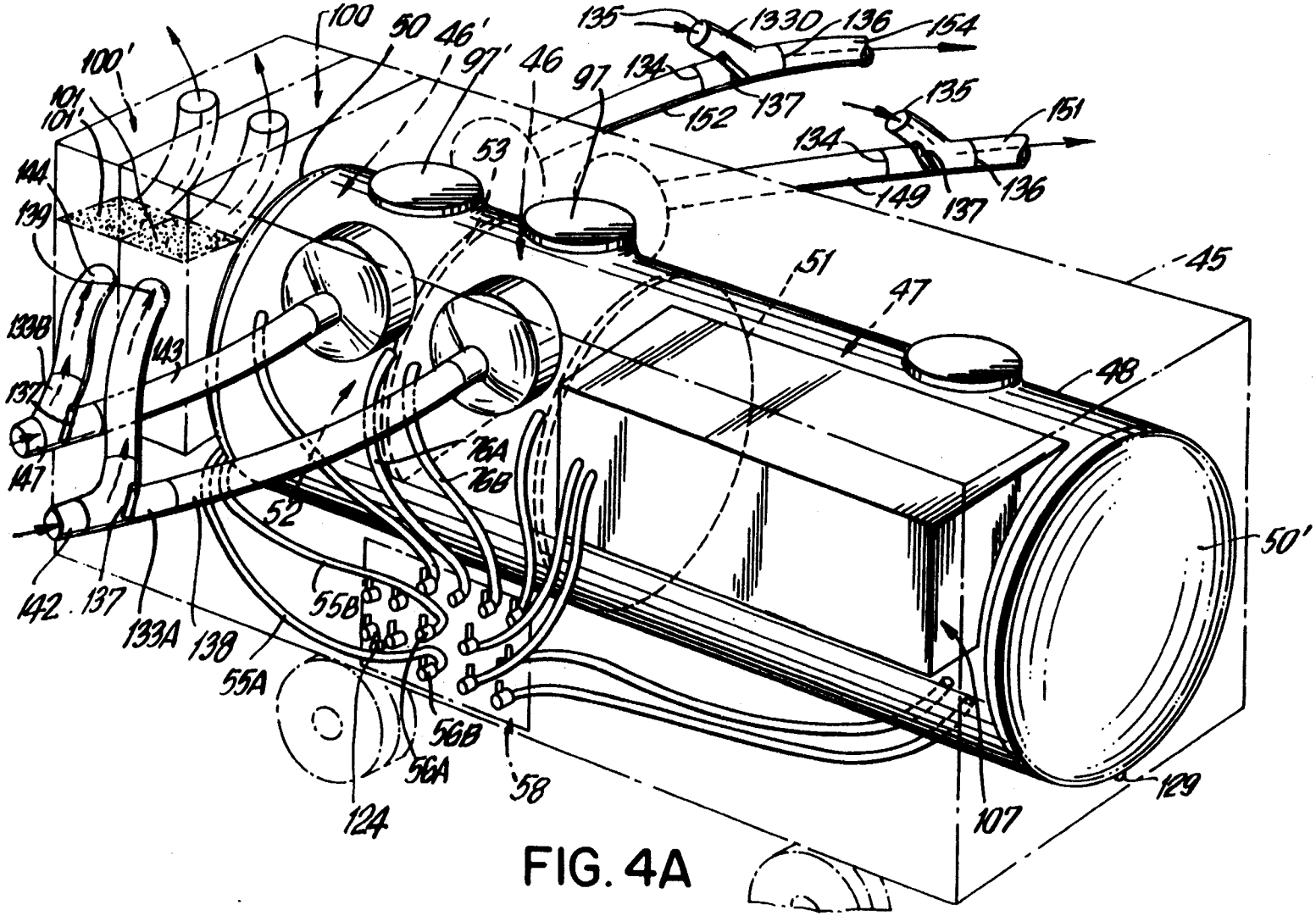
FIG. 4A is a perspective view of the transportable vessel cleaning system of FIG. 2 operably configured for a residual deposit vapor evacuation cycle or a residual solvent vapor evacuation cycle according to the present invention.

With the system prepared as described above, a deposit vapor evacuation cycle is initiated by actuating the levers of flow control devices 133A through 133D, so that devices 133C and 133D permit ambient air to flow only between ports 135 and 136, while devices 133A and 133B permit flow only between ports 135 and 136. Then, the vacuum pumps of vapor filtration units 100 and 100' are provided with a pressurized air flow by actuating the levers on air hose supply connectors 106A, 106B and 106A', 106B' at the service panel. As the vacuum pumps create vacuum sources at the inflow ports of the vapor filtration units, the gaseous mixture within the compartment interiors are transported along vapor recovery tubes 142 and 147 and passed through the vapor filtration units, filtering out various types of gasses and exhausting air to the ambient environment. Also immediately thereafter, ambient air will begin to be drawn through ports 135 of flow control devices 133C and 133D, pass along tubes 151 and 154 and fill compartment interiors 141 and 146, respectively. As illustrated in FIGS. 3A and 4A, this cycle is continued until all detectable deposit vapor in these compartment interiors is evacuated and the interiors are filled with air. When the cycle is terminated, the pressurized air supply to the vapor filtration units is shut off. At this stage, the vapor pressure within tubes 142, 147, 151 and 154 and compartment interiors 141 and 146 is substantially equal to atmospheric pressure.

SOLVENT VAPOR CLEANING CYCLE

To initiate a solvent vapor cleaning cycle, the levers of flow control devices 133A through 133D are each actuated to their alternative positions. This ensures that the vapor filtration units are operationally disconnected from tubes 139 and 144, and that substantially sealed solvent vapor delivery and recovery pathways are established between the first vapor producing chamber and compartment interior 141 and the second vapor producing chamber and compartment interior 146, as illustrated in FIGS. 3 and 4.

Circulating steam is then provided to tube structure 54 so that the temperature of solvent in solvent reservoir portion 51 is increased to the solvent vapor point, causing vapor solvent to form within the first and second vapor collecting portions of the chamber. At this stage, air power is provided to turbine fans 70 and 70' by actuating the levers on respective connectors at the service panel. As illustrated in FIGS. 3 and 4, solvent vapor is transported through the flow channels of the solvent vapor outflow ports 60, 61', along vapor delivery tubes 151 and 154 and into the upper portions of compartment interiors 141 and 146. At the substantially same time, the rotating turbine fans create a vacuum source at the solvent vapor inflow ports which cause air from the lower portions of the compartment interiors to be drawn through the vapor recovery tubes 142, 147 and into the solvent vapor inflow ports 61, 61'. Between adapters 78, 78' and fan turbine units 70, 70', the drawn air mixes with solvent vapor as hereinbefore described, producing in each solvent vapor producing chamber, a continually enriched solvent vapor stream along the direction of its vapor flow axis.

The solvent vapor stream produced from each solvent vapor producing chamber of the present invention can be delivered to the compartment interiors at a flow rate in the range of about 800 to about 1800 feet$^3$/minute when using a turbine fan unit having a flow capacity of 4,800 feet$^3$/minute and flow channels and vapor delivery tubes having cross sectional diameters of 26 and 8 inches, respectively. Conveniently, the flow rate of each solvent vapor stream can be adjusted in this range, if desired, by selecting the flow rate and/or pressure (if possible) of the air supplied to the turbine fan motors. With these available flow rates, the heat transfer between each solvent vapor producing chamber and oil storage compartment interior is sufficiently great to increase the vapor temperature within each compartment interior up to an extreme limit of about 325° F., even when the ambient temperature is low as zero °F. It is understood, however, that while such extreme cleaning temperatures are rarely required when using commercially available solvents, this thermal energy transport capacity permits the system hereof to operate effectively in subzero climates without the use of auxiliary heating units.

As solvent vapor fills each compartment interior, the vapor temperature therein increases far above ambient temperature, causing solvent vapor contacting the interior surfaces to react and condense thereon. In typical vessel cleaning applications, the vapor temperature in each compartment interior will be maintained at about 180° F. However, due to the ambient temperature in some applications, the desired vapor cleaning temperature may lie below or above this temperature, for example, within the range from about 125° F. to about 225° F. at atmospheric pressure. Solvent vapor condensate and contaminant material from the residue deposit drips downward and collects at the bottom of each compartment interior to form a liquid mixture. At this stage of the process, air power is provided to each of the diaphragm pumps at the bottom of the sealed storage compartments, causing the liquid mixture to be pumped into solvent condensate recovery chamber 47. If desired at this time, tube structure 115 in the solvent condensate recovery chamber can be provided with circulating steam while tube structure 119 is provided with circulating water. This will heat the liquid mixture to form solvent vapor, which condenses about tube structure 119 to form solvent condensate that collects in solvent condensate reservoir 122.

During steady state operation, the vapor pressure within each solvent vapor producing chamber is maintained within the range of 0.25 to about 1.0 pounds/inch$^2$ above atmospheric pressure, with the vapor temperature in each chamber being maintained within the range of about 250° to about 350° F. The vapor pressure in each compartment interior will be slightly lower due to mechanical pressure drops along the vapor delivery tubes and heat losses through the compartment walls to the ambient environment. Preferably, the vapor pressure within the compartment interiors will be within the range of about 0.10 to about 0.75 pounds/inch$^2$ above atmospheric pressure. While the system operator will monitor the temperature and pressure display meters 116A to 116D to ensure the system is operating within desired operating parameters, there typically is no need to monitor or control the vapor pressure or temperature within each sealed storage compartment being cleaned.

The solvent vapor cleaning cycle described above is continued until the color of each liquid mixture stream recovered from the bottom of each compartment interior is substantially the same as the color of liquid solvent. This condition indicates that the residue deposit on the interior surfaces has been substantially removed and the compartment interior is clean. Monitoring the color of the liquid mixture stream can be achieved by passing the recovered liquid mixture through a site glass prior to introducing the liquid mixture into the solvent condensate recovery chamber. Provision of a transparent window through cover plates, e.g. 157A and 157B, will also permit visual monitoring of the interior surfaces during the cleaning process. When the interior surfaces are sufficiently clean, steam provided to heat exchanging tube structure 54 and air power to the turbine fans 70 and 70' are terminated. Distillation of solvent in the recovery chamber can be continued as required or desired in an independent manner.

SOLVENT VAPOR EVACUATION CYCLE

Prior to opening the cleaned compartments, solvent vapor remaining in the compartment interiors and vapor recovery and delivery tubes is evacuated in an environmentally acceptable manner. This is achieved by performing a solvent vapor evacuation cycle, illustrated in FIGS. 3A and 4A. A solvent vapor evacuation cycle is initiated by actuating the levers on flow control devices 133A through 133D in the same way conducted during the deposit vapor evacuation cycle, described hereinbefore. Then, with the solvent vapor producing chambers operably disconnected from the vapor delivery and recovery tubes, air power is provided to the vacuum pump of each vapor filtration unit. The vacuum sources created at the inflow ports of these vapor filtration units operate to withdraw residual solvent vapor from each compartment interior, filter out the same across activated-charcoal vapor absorption elements 101 and 101', and fill the compartment interiors with air. Thereafter, the cleaned compartments can be opened and safely entered by workers for inspection and the like of the cleaned interior surfaces.

Having described the illustrative embodiment of the present invention, several modifications come to mind. For example, any one or more of the above described cycles can be automatically controlled by a computer control system operably associated with (i) vapor pressure and temperature sensors within the vapor producing chambers, (ii) solenoid-actuatable flow control devices 133A through 133D, and (iii) solenoid-actuatable control valves adapted to control the flow of steam, pressurized air and cooling water to the system components during system operation. An optical analyzer operably associated with the computer control system may also be provided for automatically monitoring the color and/or translucency of recovered solvent condensate from the bottom of the compartment interiors. The computer control system can be programmed to control automatically the operation of the various system components during the vessel cleaning process.

In addition to cleaning the interior of vessels, the present invention can be used to clean various types of objects bearing residue and/or protective coatings. In such applications, the vessel in which the vapor cleaning provess hereof is carried out, can be adapted to facilitate (i) introduction of the objects into the vessel interior, (ii) support of objects contained therein, and (iii) removal of the cleaned objects from the vessel interior.

While the particular embodiment shown and described above will be useful in various applications, further modifications of the present invention herein disclosed will occur to persons skilled in the art to which the present invention pertains. All such modifications are deemed to be within the scope and spirit of the present invention defined by the appended claims.

What is claimed is:

1. Apparatus for producing a solvent vapor stream for delivery to the interior of a substantially sealed vessel so that delivered solvent vapor contacts the interior surfaces of said vessel and the exterior surfaces of an object contained therein and chemically treats a coating or residue deposit thereon, said apparatus comprising:

at least one solvent vapor producing chamber having a vapor collecting portion for collecting solvent vapor produced in said solvent vapor producing chamber;

a solvent vapor outflow port and a solvent vapor inflow port both being disposed substantially along axis extending through both said solvent vapor outflow and inflow ports and said vapor collecting portion, said solvent vapor outflow and inflow ports each including flow channels aligned substantially coaxially along said vapor flow axis, said solvent vapor outflow port being adapted to receive one end of a vapor delivery tube which is capable of establishing a first vapor communication pathway between said vapor collecting portion and the interior of said vessel, said solvent vapor inflow port being adapted to receive one end of a vapor recovery tube which is capable of establishing a second vapor communication pathway between said vessel interior and said vapor collecting portion; and vapor transporting means operably associated with at least one of said solvent vapor outflow and inflow ports for forcibly transporting solvent vapor in said vapor collecting portion through said solvent vapor outflow port and said vapor delivery tube and into said vessel interior, and also for forcibly transporting solvent vapor from said vessel interior through said vapor recovery tube and said solvent vapor inflow port, and into said solvent vapor producing chamber so that solvent vapor recovered from said vessel interior intermixes with solvent vapor forming in said solvent vapor producing chamber to produce a solvent vapor stream along the direction of said vapor flow axis for delivery to said vessel interior.

2. The apparatus of claim 1, wherein said vapor transporting means comprises a turbine fan disposed in the flow channel of said solvent vapor inflow port.

3. The apparatus of claim 2, wherein said turbine fan is air powered, and wherein the flow rate of said solvent vapor stream is controllable by the selection of the flow rate of the air supply employed in driving said turbine fan.

4. The apparatus of claim 1, wherein said solvent vapor producing chamber comprises means for measuring the degree of solvent vapor saturation in said solvent vapor stream, and means for controlling the flow of produced solvent vapor into said solvent vapor stream in response to said solvent vapor saturation measurements.

5. The apparatus of claim 1, wherein said solvent vapor producing chamber has a substantially cylindrical gross geometry having a longitudinal extent, wherein said solvent vapor outflow and inflow ports each comprise flow channels aligned substantially coaxially along said vapor flow axis, and wherein said vapor flow axis is arranged substantially orthogonal with respect to said longitudinal extent.

6. The apparatus of claim 5, wherein said vapor transporting means comprises a turbine fan disposed in the flow channel of at least one of said solvent vapor outflow and inflow ports.

7. The apparatus of claim 6, wherein said turbine fan is air powered, and wherein the flow rate of said solvent vapor stream is controllable by the selection of the flow rate of the air supply employed in driving said turbine fan.

8. The apparatus of claim 1, which further comprises:

means for monitoring the vapor pressure within said vapor collecting portion of said solvent vapor producing chamber, and means for monitoring the temperature within said vapor collection portion of said solvent vapor producing chamber, and means for displaying said monitored temperatures and vapor pressure.

9. The apparatus of claim 1, wherein the flow rate of said solvent vapor flow stream moving along the direction of said vapor flow axis is within the range of from about 800 to about 1800 feet$^3$/minute.

10. The apparatus of claim 9, wherein said vapor transporting means comprises a power driven turbine fan disposed in the flow channel of at least one of said solvent vapor outflow and inflow ports.

11. The apparatus of claim 10, wherein said flow channels aligned substantially coaxially along said vapor flow axis have a circular cross section.

12. The apparatus of claim 1, wherein each said flow channel extends partially into said solvent vapor producing chamber.

13. Apparatus for producing a solvent vapor stream for delivery to the interior of a vessel substantially sealed, so that delivered solvent vapor contacts the interior surfaces of said vessel and chemically treats a coating or residue deposit thereon, said apparatus comprising:

at least one solvent vapor producing chamber having a solvent reservoir portion and a vapor collecting portion, said solvent reservoir portion adapted for containing a volume of solvent in liquid state and having disposed therein solvent heating means for heating said solvent to form solvent vapor which collects in said vapor collecting portion;

a solvent vapor outflow port and a solvent vapor inflow port both being disposed substantially along a vapor flow axis extending through both said solvent vapor outflow and inflow ports and said vapor collecting portion, said solvent vapor outflow and inflow ports each including flow channels aligned substantially coaxially along said vapor flow axis, said solvent vapor outflow port being adapted to receive one end of a vapor delivery tube which is capable of establishing a first vapor communication pathway between said vapor collecting portion and the interior of said vessel, said solvent vapor inflow port being adapted to receive one end of a vapor recovery tube which is capable of establishing a second vapor communication pathway between said vessel interior and said vapor collecting portion;

vapor transporting means operably associated with at least one of said solvent vapor outflow and inflow ports for forcibly transporting solvent vapor in said vapor collecting portion through said solvent vapor outflow port and said vapor delivery tube and into said vessel interior, and also for forcibly transporting solvent vapor from said vessel interior, through said vapor recovery tube and said solvent vapor inflow port and into said vapor collecting chamber so that solvent vapor recovered from said vessel interior intermixes with solvent vapor forming in said solvent vapor producing chamber to produce a solvent vapor stream along the direction of said vapor flow axis for delivery to said vessel interior; and means disposed above said solvent heating means for reducing entrainment of liquid solvent within said solvent vapor stream as said vapor transporting means forcibly transports said solvent vapor stream above said solvent reservoir portion along the direction of said vapor flow axis and through said vapor outflow port.

14. The apparatus of claim 13, wherein said vapor transporting means comprises a turbine fan disposed in the flow channel of said solvent vapor inflow port.

15. The apparatus of claim 14, wherein said turbine fan is air powered, and wherein the flow rate of said solvent vapor stream is controllable by the selection of the flow rate of the air supply employed in driving said turbine fan.

16. The apparatus of claim 15, wherein said solvent heating means comprises a heat exchanging tube structure adapted for conducting a heat carrying medium supplied by a source of heat carrying medium.

17. The apparatus of claim 16, wherein said heat exchanging tube structure comprises multiple levels of tubing adapted for conducting said heat carrying medium, and wherein said apparatus further comprises means for monitoring the level of liquid solvent in said solvent reservoir portion.

18. The apparatus of claim 13, wherein said solvent vapor producing chamber comprises an access port formed therein above said vapor collecting portion for permitting access to the interior of said solvent vapor producing chamber.

19. The apparatus of claim 13, wherein said solvent vapor producing chamber has a substantially cylindrical gross geometry having a longitudinal extent, wherein said solvent vapor outflow and inflow ports each comprise flow channels aligned substantially coaxially along said vapor flow axis, and wherein said vapor flow axis is arranged substantially orthogonal with respect to said longitudinal extent.

20. The apparatus of claim 19, wherein said vapor transporting means comprises a turbine fan disposed in the flow channel of said solvent vapor inflow port and has a flow passageway between said turbine fan and said flow channel.

21. The apparatus of claim 20, wherein said turbine fan is air powered, and wherein the flow rate of said solvent vapor stream is controllable by the selection of the flow rate of the air supply employed in driving said turbine fan.

22. The apparatus of claim 21, wherein said solvent heating means comprises a heat exchanging tube structure adapted for conducting a heat carrying medium supplied by a source of heat carrying medium.

23. The apparatus of claim 22, wherein said heat exchanging tube structure comprises multiple levels of tubing adapted for conducting said heat carrying medium, and wherein said apparatus further comprises means for monitoring the level of liquid solvent in said solvent reservoir portion.

24. The apparatus of claim 23, wherein said solvent vapor producing chamber comprises an access port formed therein above said vapor collecting portion for permitting access to the interior of said solvent vapor producing chamber.

25. The apparatus of claim 14, which further comprises:

means for monitoring the vapor pressure within said vapor collecting portion of said solvent vapor producing chamber;

means for monitoring the temperature within said vapor collection portion of said solvent vapor producing chamber, and means for displaying said monitored temperatures and vapor pressure.

26. The apparatus of claim 14, wherein the flow rate of said solvent vapor flow stream moving along the direction of said vapor flow axis is within the range of from about 800 to about 1800 feet$^3$/minute.

27. The apparatus of claim 26, wherein said solvent vapor outflow and inflow ports each comprise flow channels aligned substantially coaxially along said vapor flow axis.

28. The apparatus of claim 27, wherein said vapor transporting means comprises a power driven turbine fan disposed in the flow channel of said solvent vapor outflow and inflow port, and has a flow passageway between said turbine fan and said flow channel.

29. The apparatus of claim 28, wherein said flow channels aligned substantially coaxially along said vapor flow axis, have a circular cross section.

30. A transportable system for producing and delivering a solvent vapor stream to the interior of a vessel substantially sealed so that said delivered solvent vapor contacts the interior surfaces of said vessel, chemically treats a coating thereon, and condenses into solvent condensate which drips down said interior surfaces to form a liquid mixture of solvent condensate and dissolved coating at the bottom of said vessel, said transportable system comprising:

a transportable platform which can be transported to a site at which said vessel resides;

at least one solvent vapor producing chamber mounted on said transportable platform, and having a solvent reservoir portion and a vapor collecting portion, said solvent reservoir portion adapted for containing a volume of vaporizable solvent in liquid state and having disposed therein solvent heating means for heating said vaporizable solvent to from solvent vapor which collects in said vapor collecting portion;

a solvent vapor outflow port and a solvent vapor inflow port both being disposed substantially along a vapor flow axis extending through both said solvent vapor outflow and inflow ports and said vapor collecting portion, said solvent vapor outflow and inflow ports each including flow channels aligned substantially coaxially along said vapor flow axis, said solvent vapor outflow port being adapted to receive one end of a vapor delivery tube which is capable of establishing a first vapor communication pathway between said vapor collecting portion and the interior of said vessel, and said solvent vapor inflow port being adapted to receive one end of a vapor recovery tube which is capable of establishing a second vapor communication pathway between said vessel interior and said vapor collecting portion;

air-powered vapor transporting means operably associated with at least one of said solvent vapor outflow and inflow ports for forcibly transporting solvent vapor in said vapor collection portion through said solvent vapor outflow port and said vapor delivery tube and into the interior of said vessel, and also for simultaneously transporting solvent vapor from said vessel interior, through said vapor recovery tube and said solvent vapor inflow port and into said vapor collection portion so that solvent vapor recovered from said vessel interior passes through said solvent vapor inflow port and intermixes with solvent vapor forming in said vapor producing chamber to produce a solvent vapor stream along the direction of said vapor flow axis for delivery to said vessel interior;

means for operably connecting said air-powered vapor transporting means to a supply of pressurized air available at said site;

means for operably connecting said solvent heating means to a supply of heat carrying medium available at said site; and means disposed above said solvent heating means for reducing entrainment of liquid solvent within said solvent vapor stream as said air-powered vapor transporting means forcibly transports said solvent vapor stream above said reservoir portion along the direction of said vapor flow axis and through said solvent vapor outflow port.

31. The transportable system of claim 30, which further comprises a solvent condensate recovery chamber mounted on said transportable platform, and having a liquid mixture reservoir portion and solvent vapor condensing portion in vapor communication with the interior of said solvent condensate recovery chamber, said liquid mixture reservoir portion being adapted for containing a volume of said liquid mixture recovered from the bottom of said vessel and having disposed therein mixture heating means for heating said liquid mixture to from solvent vapor which circulates within said solvent vapor condensing portion, said solvent vapor condensing portion having disposed therein solvent vapor cooling means for cooling said circulating solvent vapor to form solvent condensate.

32. The transportable system of claim 31 which further comprises solvent condensate collection means in fluid communication with said solvent vapor condensing portion for collection of said solvent condensate.

33. The transportable system of claim 31, which further comprises vapor filtration means for filtering out solvent vapor from a gaseous mixture of solvent vapor and/or air being transported out from said vessel interior.

34. The transportable system of claim 33, wherein said vapor filtration means comprises a vapor absorption element and a vacuum producing means for drawing said gaseous mixture from said vessel interior and through said vapor absorption element.

35. The transportable system of claim 34, wherein said vacuum producing means is an air-powered vacuum device, and said transportable system further comprises means for operably connecting said vacuum device to a supply of pressurized air available at said vessel site.

36. A system for producing and delivering a solvent vapor stream to the interior of a vessel substantially sealed, so that delivered solvent vapor contacts the interior surfaces of said vessel and chemically treats a coating or residue deposit thereon, said system comprising:

at least one solvent vapor producing chamber having a solvent reservoir portion and a vapor collecting portion, said solvent reservoir portion adapted for containing a selected volume of solvent in liquid state and having disposed therein solvent heating means for heating said solvent to form solvent vapor which collects in said vapor collecting portion;

a solvent vapor outflow port and a solvent vapor inflow port both being disposed substantially along a vapor flow axis extending through both said solvent vapor outflow and inflow ports and said vapor collecting portion;

a vapor delivery tube having a first end connected to said solvent vapor outflow port and a second end operably connected to a first access port in said vessel so as to establish a first vapor communication pathway between said vapor collecting portion and the interior of said vessel;

a vapor recovery tube having a first end operably connected to said solvent vapor inflow port and a second end operably connected to a second access port in said vessel so as to establish a second vapor communication pathway between of said vessel interior and said vapor collecting portion; and vapor transporting means operably associated with at least one of said solvent vapor outflow and inflow ports for forcibly transporting solvent vapors in said vapor collecting portion through said solvent vapor outflow port and said vapor delivery tube, and into said vessel interior, and also forcibly transporting solvent vapor in said vessel interior through said vapor recovery tube and said solvent vapor inflow port and into said solvent vapor producing chamber so that solvent vapor recovered from said vessel interior intermixes with solvent vapor forming in said solvent vapor producing chamber to produce a solvent vapor stream along the direction of said vapor flow axis for delivery to said vessel interior through said flexible vapor delivery tube.

37. The system of claim 36, which further comprises pumping means, disposed within said vessel interior, for pumping from said vessel a liquid mixture of solvent condensate and dissolved coating and/or residue deposit formed in response to delivered solvent vapor contacting said interior surfaces and condensing thereon; and liquid mixture collecting means for collecting said liquid mixture pumped out from said vessel interior during delivery of solvent vapor to said vessel interior.

38. A system for producing and delivering a solvent vapor stream to the interior of a vessel substantially sealed, so that delivered solvent vapor contacts the interior surfaces of said vessel and chemically treats a coating or residue deposit thereon, said system comprising:

at least one solvent vapor producing chamber having a solvent reservoir portion and a vapor collecting portion, said solvent reservoir portion adapted for containing a selected volume of solvent in liquid state and having disposed therein solvent heating means for heating said solvent to form solvent vapor which collects in said vapor collecting portion;

a solvent vapor outflow port and a solvent vapor inflow port both being disposed substantially along a vapor flow axis extending through both said solvent vapor outflow and inflow ports and said vapor collecting portion;

a vapor delivery tube having a first end connected to said solvent vapor outflow port and a second end operably connected to a first access port in said vessel so as to establish a first vapor communication pathway between said vapor collecting portion and the interior of said vessel;

a vapor recovery tube having a first end operably connected to said solvent vapor inflow port and a second end operably connected to a second access port in said vessel so as to establish a second vapor communication pathway between of said vessel interior and said vapor collecting portion;

vapor transporting means operably associated with at least one of said solvent vapor outflow and inflow ports for forcibly transporting solvent vapors in said vapor collecting portion through said solvent vapor. outflow port and said vapor delivery tube, and into said vessel interior, and also forcibly transporting solvent vapor in said vessel interior through said vapor recovery tube and said solvent Vapor inflow port and into said solvent vapor producing chamber so that solvent vapor recovered from said vessel interior intermixes with solvent vapor forming in said solvent vapor producing chamber to produce a solvent vapor stream along the direction of said vapor flow axis for delivery to said vessel interior through said flexible vapor delivery tube;

pumping means, disposed within said vessel interior, for pumping from said vessel a liquid mixture of solvent condensate and dissolved coating and/or residue deposit formed in response to delivered solvent vapor contacting said interior surfaces and condensing thereon;

liquid mixture collecting means for collecting said liquid mixture pumped out from said vessel interior during delivery of solvent vapor to said vessel interior; and a first flow control means operably connected between said solvent vapor inflow port and along a portion of said vapor delivery tube and capable of being operated in a first position and a second position, wherein when operated in said first position, said first flow control means occludes air flow between both the ambient environment and said vapor collecting portion, and said ambient environment and said vessel interior, and wherein when operated in said second position, said first flow control means occludes vapor communication between said vapor collecting porting and said vessel interior through said solvent vapor inflow port, while permitting air flow between the ambient environment and said vessel interior;

vapor filtration means for filtering out solvent vapor from a gaseous mixture of solvent vapor and air being transported out from said vessel interior, said vapor filtration means having a vapor/air inflow port for inflow of solvent vapor and/or air, and an air outflow port for outflow of substantially solvent free air, and further including a vapor absorption element and vacuum producing means for transporting said gaseous mixture from said vessel interior and through said vapor/air inflow port and said vapor adsorption element, so as to filter out solvent vapor and pass essentially solvent-free air out said air outlet port to said ambient environment; and second flow control means operably connected at least between said vapor/air inflow port and a portion of said vapor delivery tube and capable of being operated in a first position and a second position, wherein when operated in said first position, said second flow control means occludes vapor communication between said vapor/air inflow port and said vessel interior while permitting vapor communication between said vapor collecting portion and said vessel interior, and wherein when operated in said second position, said second flow control means occludes vapor communication between said vapor collecting portion and said vessel portion, while permitting vapor communication between said vessel portion and said vapor/air inflow port.

39. The system of claim 38, wherein said solvent producing chamber comprises an access port formed therein above said vapor collecting portion for permitting access to interior of said solvent vapor producing chamber.

40. The system of claim 39, wherein said vapor producing chamber has a substantially cylindrical gross geometry having a longitudinal extent, wherein said solvent vapor outflow and inflow ports each comprise flow channels aligned substantially coaxially along said vapor flow axis, and wherein said vapor flow axis is arranged substantially orthogonal with respect to said longitudinal extent.

41. The system of claim 40, wherein said vapor transporting means comprises a turbine fan disposed in the flow channel of said solvent vapor inflow port.

42. The system of claim 41, wherein said turbine fan is air powered, and wherein the flow rate of said solvent vapor stream is controllable by the control of the flow rate of the air supply employed in driving said turbine fan.

43. The system of claim 42, wherein said solvent heating means comprises a heat exchanging tube structure adapted for conducting a heat carrying medium supplied by a source of heat carrying medium.

44. The system of claim 43, wherein said heat exchanging tube structure comprises multiple levels of tubing adapted for conducting said heat carrying medium, and wherein said apparatus further comprises means for monitoring the level of liquid solvent in said solvent reservoir portion.

45. The system of claim 38, which further comprises:

means for monitoring the vapor pressure within said vapor collecting portion of said solvent producing chamber, and means for monitoring the temperature within said vapor collection portion of said solvent producing chamber, and means for displaying said monitored temperatures and vapor pressure.

46. The system of claim 38, wherein the flow rate of said solvent vapor flow stream moving along the direction of said vapor flow axis is within the range of from about 800 to about 1800 feet$^3$/minute.

47. The apparatus of claim 38, wherein said solvent vapor outflow and inflow ports each comprise flow channels aligned substantially coaxially along said vapor flow axis and extending partially into said vapor collecting portion of said vapor producing chamber.

48. The apparatus of claim 47, wherein said vapor transporting means comprises a turbine fan disposed in the flow channel of said solvent vapor inflow port.

49. The apparatus of claim 48, wherein said flow channels aligned coaxially along said vapor flow axis have a circular cross section.

50. The apparatus of claim 47, wherein each said vapor outflow and inflow port has a port diameter and means for adapting said port diameter to the diameter of said flow channel.

51. A transportable system for producing and delivering a solvent vapor stream to the interior of a vessel substantially sealed, so that said delivered solvent vapor contacts the interior surfaces of said vessel, chemically treats a coating thereon and condenses into solvent condensate which drips down said interior surfaces to form a liquid mixture of solvent condensate and dissolved coating at the bottom of said vessel, said transportable system comprises:

a transportable platform which can be transported to a site at which said vessel resides, said transportable platform having first and second sides which oppose each other and between which a support surface is disposed;

at least one solvent producing chamber mounted on said support surface of said transportable platform, and having a solvent reservoir portion and a vapor collecting portion, said solvent reservoir portion adapted for containing a volume of solvent in liquid state and having disposed therein solvent heating means for heating said solvent to form solvent vapor which collects in said vapor collecting portion;

a solvent vapor outflow port and a solvent vapor inflow port both being disposed substantially along a Vapor flow axis extending through both said solvent vapor outflow and inflow ports and said vapor collecting portion, said solvent vapor outflow port being positioned on said first platform side and adapted to receive one end of a vapor delivery tube which is capable of establishing a first vapor communication pathway between said vapor collecting portion and the interior of said vessel, and said solvent vapor inflow port being positioned on said second platform side and adapted to receive one end of a vapor recovery tube which is capable of establishing a second vapor communication pathway between said vessel interior and said vapor collecting portion;

air-powered vapor transporting means operably associated with at least one of said solvent vapor outflow and inflow ports for forcibly transporting solvent vapor in said vapor collection portion through said solvent vapor outflow port and said vapor delivery tube and into said vessel interior, and also for forcibly transporting solvent vapor from the said vessel interior through said vapor recovery tube and said solvent vapor inflow port and into said solvent vapor producing chamber so that solvent vapor recovered from said vessel interior passes through said solvent vapor inflow port and intermixes with solvent vapor forming in said solvent vapor producing chamber to produce a solvent vapor stream along the direction of said vapor flow axis for delivery to said vessel interior;

means for operably connecting said vapor transporting means to a supply of pressurized air provided at said vessel site;

means for operably connecting said solvent heating means to a supply of heat carrying medium provided at said vessel site; and means disposed above said solvent heating means for reducing entrainment of liquid solvent within said solvent vapor stream as said vapor transporting means forcibly transports said solvent vapor stream above said reservoir portion along the direction of said vapor flow axis and through said solvent vapor outflow port.

52. The transportable system of claim 51, which further comprises a plurality of vapor baffle elements spatially arranged in a parallel fashion substantially orthogonal to the direction of said vapor flow axis and being positioned above said solvent heating means, so as to permit upwardly rising solvent vapor to flow between said vapor baffle elements, while reducing entrainment of liquid solvent within said solvent vapor.

53. The transportable system of claim 52, which further comprises a vapor transmissive structure disposed above said vapor baffle elements for reducing entrainment of solvent mist in solvent vapor passing upwardly through said vapor baffle elements.

54. The transportable system of claim 53, wherein said vapor transmissive structure comprises a perforated screen of thermally conductive material having a plurality of apertures with dimensions on the order of about 1/16 to about ¼ inch.

55. The transportable system of claim 53, wherein said vapor transmissive structure comprises a mesh screen.

56. The transportable system of claim 42, wherein said solvent vapor outflow and inflow ports each comprise flow channels aligned substantially coaxially along said vapor flow axis.

57. The transportable system of claim 42, which further comprises a solvent condensate recovery chamber mounted on said transportable platform, and having a liquid mixture reservoir portion and solvent vapor condensing portion in vapor communication with the interior of said solvent condensate recovery chamber, said liquid mixture reservoir portion being adapted for containing a volume of said liquid mixture recovered from the bottom of said vessel interior and having disposed therein liquid mixture heating means for heating said liquid mixture to form solvent vapor which circulates within said solvent vapor condensing portion, said solvent vapor condensing portion having disposed therein solvent vapor cooling means for cooling said circulating solvent vapor to form solvent condensate.

58. The transportable system of claim 57 which further comprises solvent condensate collection means in fluid communication with said solvent vapor condensing portion, for collection of solvent condensate.

59. The transportable system of claim 42, which further comprises vapor filtration means for filtering out solvent vapor from a gaseous mixture of solvent vapor and/or air being transported out from said vessel interior.

60. The transportable system of claim 59, wherein said vapor filtration means comprises a vapor absorption element and a vacuum producing means for transporting said gaseous mixture from said vessel interior, and through said vapor recovery tube and said vapor absorption element.

61. The transportable system of claim 59, wherein said vacuum producing means source is air powered, and said transportable system further comprises means for operably connecting said vacuum producing means to a supply of pressurized air available at said vessel site.

62. Apparatus for producing a plurality of solvent vapor streams each for delivery to the interior of a substantially sealed vessel, so that delivered solvent vapor contacts the interior surfaces of each said vessel and chemically treats a coating or residue deposit thereon, said apparatus comprising:

a solvent vapor producing chamber having a plurality of vapor collecting portions, each vapor collecting portion being in isolation from each other said vapor collecting portion;

a plurality of solvent vapor outflow and inflow ports, each said solvent vapor outflow port being substantially aligned with one said solvent vapor inflow port along a vapor flow axis which passes through one said vapor collecting portion and said substantially aligned solvent vapor outflow and inflow ports, said solvent vapor outflow and inflow ports each including flow channels aligned substantially coaxially along one said vapor flow axis, each said solvent vapor outflow port being adapted to receive one end of a vapor delivery tube which is capable of establishing a first vapor communication pathway between said vapor collecting portion and said vessel interior, and each said substantially axially aligned solvent vapor inflow port being adapted to receive one end of a vapor recovery tube which is capable of establishing a second vapor communication between said vessel interior and said vapor collecting portion; and a plurality of vapor transporting means, each operably associated with at least one of said solvent vapor outflow and inflow ports along one said vapor flow axis, for forcibly transporting solvent vapor in one said vapor collecting portion through one said solvent vapor outflow port and one said vapor delivery tube and into said vessel interior, and also for transporting solvent vapor from one said vessel interior, through one said vapor recovery tube and one said solvent vapor inflow port, and into one said vapor collecting portion so that solvent vapor recovered from one said vessel interior intermixes with solvent vapor forming in one said solvent vapor producing chamber to thereby produce a solvent vapor stream along the direction of one said vapor flow axis for delivery to one said receptacle interior.

63. The apparatus of claim 62, wherein each said vapor transporting means comprises a turbine fan disposed in one said flow channel.

64. The apparatus of claim 63, wherein each said turbine fan is air powered, and wherein the flow rate of each said solvent vapor stream is controllable by the selection of the flow rate of the air supply employed in driving said turbine fan.

65. The apparatus of claim 62, wherein said solvent vapor producing chamber comprises an access port formed therein above each said vapor collecting portion for permitting access to the interior of each said vapor collecting portion.

66. The apparatus of claim 62, wherein said solvent vapor producing chamber has a substantially cylindrical gross geometry having a longitudinal extent, wherein said solvent vapor outflow and inflow ports each comprise flow channels aligned substantially coaxially along one said vapor flow axis, and wherein each said vapor flow axis is arranged substantially orthogonal with respect to said longitudinal extent.

67. The apparatus of claim 66, wherein each said vapor transporting means comprises a turbine fan disposed in one said flow channel.

68. The apparatus of claim 67, wherein said turbine fan is air powered, and wherein the flow rate of said solvent vapor stream is controllable by the selection of the flow rate of the air supply employed in driving said turbine fan.

69. The apparatus of claim 62, which further comprises:

means for monitoring the vapor pressure within each said vapor collecting portion of said solvent vapor producing chamber, and means for monitoring the temperature within each said vapor collection portion of said solvent vapor producing chamber, and means for displaying said monitored temperatures and vapor pressures.

70. The apparatus of claim 62, wherein the flow rate of each said solvent vapor stream moving along the direction of said vapor flow axis is within the range of from about 800 to about 1800 feet$^3$/minute.

71. The apparatus of claim 70, wherein said solvent vapor outflow and inflow ports each comprise flow channels aligned coaxially along one said vapor flow axis and extending partially into one said vapor collecting portion of said solvent vapor producing chamber.

72. The apparatus of claim 71, wherein each said vapor transporting means comprises a turbine fan disposed in one said flow channel.

73. The apparatus of claim 72, wherein each said flow channel has a circular cross section.

74. The apparatus of claim 62, wherein said solvent vapor producing chamber further comprises a solvent reservoir portion for containing a volume of solvent in liquid state, and having disposed therein at least one solvent heating means for heating said solvent to form solvent vapor which collects in each said vapor collection portion.

75. The apparatus of claim 74, wherein said solvent heating means comprises a heat exchanging tube structure adapted for conducting a heat carrying medium supplied by a source of heat carrying medium.

76. The apparatus of claim 75, wherein said heat exchanging tube structure comprises multiple levels of tubing adapted for conducting said heat carrying medium, and wherein said apparatus further comprises means for monitoring the level of liquid solvent in said solvent reservoir portion.

77. The apparatus of claim 62, which further comprises means disposed above said solvent heating means, for reducing entrainment of liquid solvent within each said solvent vapor stream as each said vapor transporting means forcibly transports said solvent vapor stream above said solvent reservoir portion along the direction of said vapor flow axis and through said vapor outflow port.

* * * * *